US011815332B2

(12) United States Patent
Eaton et al.

(10) Patent No.: US 11,815,332 B2
(45) Date of Patent: Nov. 14, 2023

(54) WEAPON SIGHT

(71) Applicant: Sig Sauer, Inc., Newington, NH (US)

(72) Inventors: Trevor Eaton, South Hampton, NH (US); Tyler Rainaud, Nottingham, NH (US); Chris Bova, Barrington, NH (US); Benjamin L. Froburg, Dover, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/696,088

(22) Filed: Mar. 16, 2022

(65) Prior Publication Data

US 2023/0296352 A1 Sep. 21, 2023

(51) Int. Cl.
*F41G 1/34* (2006.01)
*F41G 1/28* (2006.01)

(52) U.S. Cl.
CPC ..... *F41G 1/345* (2013.01); *F41G 1/28* (2013.01)

(58) Field of Classification Search
CPC ... F41G 1/42; F41G 1/425; F41G 1/28; F41G 1/02; F41G 1/033; F41G 1/04
USPC ..... 42/132, 112, 113, 133, 144, 145
See application file for complete search history.

(56) References Cited

U.S. PATENT DOCUMENTS 2,546,777 A 3/1951 Pierce
3,190,002 A 6/1965 Bliss
3,192,632 A 7/1965 Von Stavenhagen
4,628,611 A 12/1986 Ruffino
4,918,823 A 4/1990 Santiago
5,878,521 A 3/1999 Warnock
5,930,906 A * 8/1999 Howe ..... F41G 1/32 42/144
6,035,539 A 3/2000 Hollenbach et al.
6,068,483 A 5/2000 Minor
6,122,833 A 9/2000 Lorocco
6,256,915 B1 7/2001 Da Silveira
6,286,242 B1 9/2001 Klebes
6,327,806 B1 12/2001 Paige
6,367,189 B1 4/2002 Clay
(Continued)

OTHER PUBLICATIONS

Personal Defense World, "8 Reflex-Ready Handguns Right Out of the Box" available at https://www.personaldefenseworld.com/2014/12/8-reflex-ready-handguns-right-out-of-the-box/ (Dec. 8, 2014).
(Continued)

*Primary Examiner* — John Cooper
(74) *Attorney, Agent, or Firm* — Finch & Maloney PLLC

(57) ABSTRACT

An adjustable firearm sight includes a body made of a flexible and resilient material. The body includes an elevation arm connected to the body and extending proximally therefrom to a sight portion, where the elevation arm and the body comprise a monolithic structure. A cam body below the elevation arm has a cam surface in contact with a bottom surface of the elevation arm, where the cam body is rotatable to change a vertical position of the sight portion. Also disclosed is a front sight assembly where a sight element is disposed in a longitudinal bore through a sight body. A proximal end of the longitudinal bore has a reduced size. At a distal end, a retention pin is disposed in a retention bore that extends transversely to and intersects the longitudinal bore such that the retention pin occupies the longitudinal bore to retain the sight element.

8 Claims, 18 Drawing Sheets

(56) References Cited

U.S. PATENT DOCUMENTS

| | | | | |
|---|---|---|---|---|
| D611,113 | S | 3/2010 | Kay | |
| 8,109,023 | B2 | 2/2012 | Pikielny | |
| 8,997,393 | B2 | 4/2015 | Bar Yona | |
| 9,285,186 | B1 | 3/2016 | Di Veroli et al. | |
| 9,395,129 | B2 | 7/2016 | Ball | |
| 9,453,706 | B1 | 9/2016 | Crispin | |
| 9,658,030 | B1 | 5/2017 | Heacock | |
| 9,823,044 | B1 | 11/2017 | Cabrera et al. | |
| 9,869,526 | B1 | 1/2018 | Cheng et al. | |
| 10,024,628 | B2 | 7/2018 | Toner et al. | |
| 10,088,274 | B2 * | 10/2018 | Howe | F41G 1/345 |
| 10,088,275 | B1 | 10/2018 | Warren | |
| 10,180,306 | B2 | 1/2019 | Ben Zion et al. | |
| 10,563,955 | B2 | 2/2020 | Pniel et al. | |
| 10,830,560 | B2 | 11/2020 | Barnett et al. | |
| 10,871,350 | B1 | 12/2020 | Thomas et al. | |
| 10,928,161 | B2 * | 2/2021 | Cabrera | F41G 1/02 |
| 10,969,195 | B1 | 4/2021 | Clark | |
| 11,340,041 | B2 * | 5/2022 | Salamon, III | F41G 1/345 |
| 11,530,898 | B2 * | 12/2022 | Howe | F41G 1/345 |
| 2004/0010956 | A1 | 1/2004 | Bubits | |
| 2006/0207157 | A1 | 9/2006 | Keng | |
| 2007/0089598 | A1 | 4/2007 | Courty | |
| 2007/0266573 | A1 | 11/2007 | Wilson | |
| 2008/0039962 | A1 | 2/2008 | McRae | |
| 2008/0092423 | A1 | 4/2008 | Keng | |
| 2008/0092424 | A1 | 4/2008 | Keng | |
| 2008/0092425 | A1 | 4/2008 | Keng | |
| 2009/0013581 | A1 * | 1/2009 | LoRocco | F41G 1/345 42/132 |
| 2010/0281725 | A1 | 11/2010 | Arbouw | |
| 2011/0197491 | A1 | 8/2011 | McCann | |
| 2011/0252682 | A1 | 10/2011 | Delgado Acarreta | |
| 2011/0314721 | A1 | 12/2011 | Lamb | |
| 2012/0144721 | A1 * | 6/2012 | Glimpse | F41G 1/32 42/144 |
| 2012/0311912 | A1 | 12/2012 | Howe et al. | |
| 2013/0111799 | A1 | 5/2013 | Lee et al. | |
| 2013/0219767 | A1 | 8/2013 | Peterson et al. | |
| 2014/0096430 | A1 | 4/2014 | Kruse | |
| 2014/0223797 | A1 | 8/2014 | Bar Yona | |
| 2014/0250758 | A1 | 9/2014 | Orlob | |
| 2015/0219425 | A1 | 8/2015 | Beckman | |
| 2015/0241175 | A1 | 8/2015 | Wolf | |
| 2015/0377572 | A1 | 12/2015 | Darragjati | |
| 2016/0102942 | A1 | 4/2016 | Abo | |
| 2016/0195351 | A1 | 7/2016 | Burden | |
| 2017/0016697 | A1 * | 1/2017 | Jones | F41G 1/01 |
| 2017/0051993 | A1 | 2/2017 | Imbriano et al. | |
| 2017/0184375 | A1 | 6/2017 | Huff | |
| 2017/0219313 | A1 | 8/2017 | Howe et al. | |
| 2018/0087871 | A1 | 3/2018 | Toner | |
| 2018/0128563 | A1 | 5/2018 | Righi et al. | |
| 2018/0195835 | A1 | 7/2018 | Crispin et al. | |
| 2018/0196628 | A1 | 7/2018 | Samo | |
| 2019/0186870 | A1 * | 6/2019 | Barnett | G02B 7/24 |
| 2019/0257620 | A1 | 8/2019 | Zimmer | |
| 2019/0331461 | A1 | 10/2019 | Zimmer | |
| 2020/0025518 | A1 | 1/2020 | Nackel et al. | |
| 2020/0025520 | A1 | 1/2020 | Niswander et al. | |
| 2020/0049455 | A1 | 2/2020 | Hamilton et al. | |
| 2020/0103201 | A1 | 4/2020 | Cabrera et al. | |
| 2020/0232601 | A1 | 7/2020 | Chavez et al. | |
| 2020/0232762 | A1 | 7/2020 | Hamilton et al. | |
| 2020/0271419 | A1 | 8/2020 | Grace | |
| 2020/0278166 | A1 | 9/2020 | Adika | |
| 2020/0333108 | A1 | 10/2020 | Berean | |
| 2021/0372737 | A1 | 12/2021 | Masarik et al. | |

OTHER PUBLICATIONS

Taurus USA, "Taurus TX 22" available at https:www.taursusa.com/pistols/taurustx-22 (Retrieved Mar. 15, 2022).

United States Patent and Trademark Office, Non-Final Office action issued in U.S. Appl. No. 18/060,762 (dated Mar. 15, 2023).

* cited by examiner

WEAPON SIGHT

FIELD OF THE DISCLOSURE

This disclosure relates generally to weapons sights and more specifically to sights for a firearm, such as front and rear sights for a handgun.

BACKGROUND

Firearms operators have traditionally used some type of sights to improve aiming thereby assisting in making a shot impact a target at a desired location. For example, rifles and pistols often include a front sight and a rear sight mounted on the barrel, where the operator aligns the front sight (e.g., a post) with the rear sight (e.g., a notch or V) to establish a sight picture that includes the intended target. Such sights may be referred to as "iron sights" since they traditionally have been made of metal. Other sights may be configured as optical or telescopic sights. It is desirable for the user of a weapon to be able to adjust the sights as needed to improve accuracy.

BRIEF DESCRIPTION OF THE DRAWINGS

The accompanying drawings, which are incorporated in and constitute a part of this specification, illustrate embodiments of the present disclosure and, together with a general description provided herein, and the detailed description of the embodiments given below, serve to explain the principles of the present disclosure.

Figure 1:
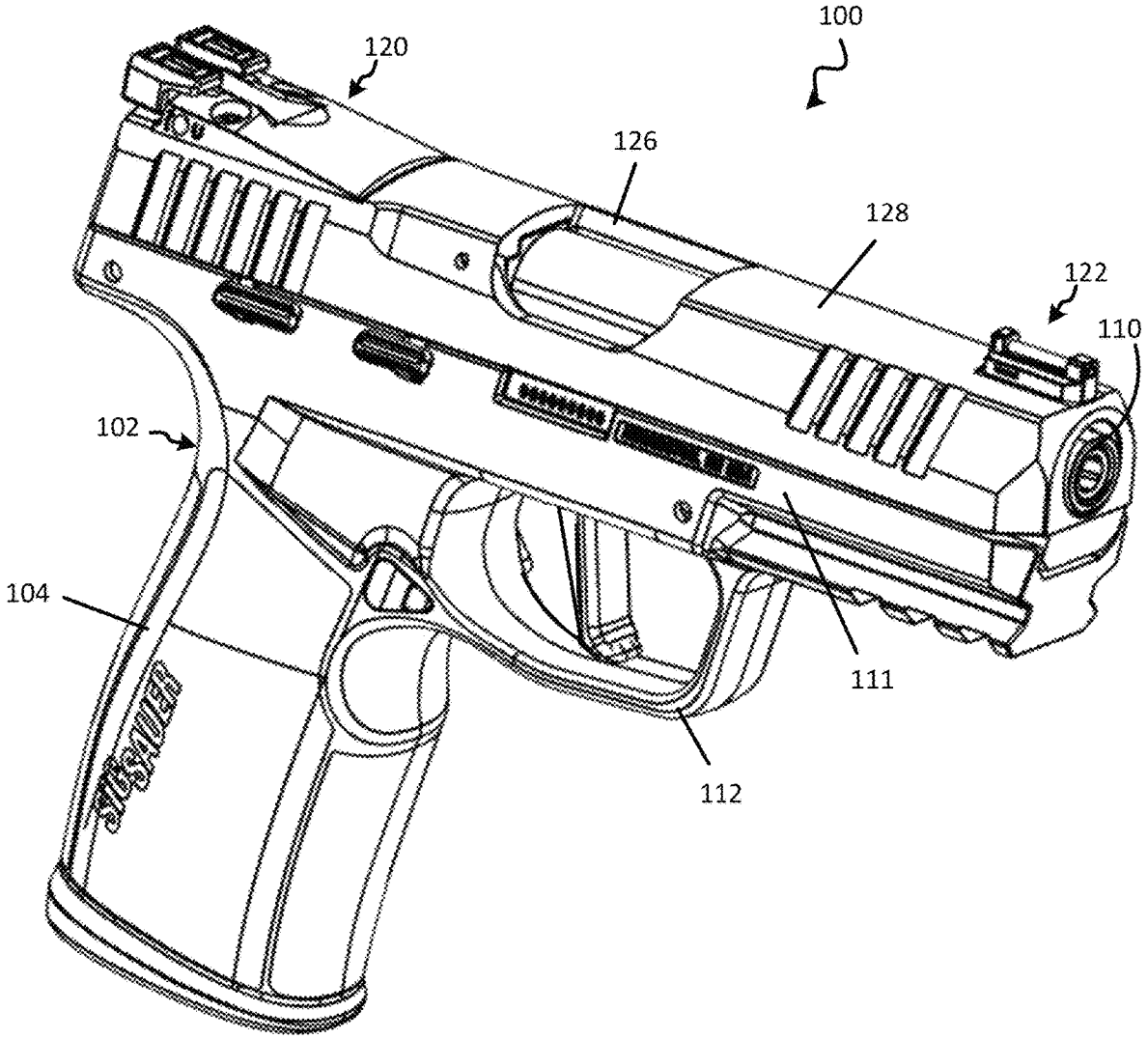
FIG. 1 shows a front perspective view of a handgun according to an embodiment of this disclosure.

The figures depict various embodiments of the present disclosure for purposes of illustration only. Numerous variations, configurations, and other embodiments will be apparent from the following detailed discussion.

DETAILED DESCRIPTION

Disclosed herein is a front sight assembly and a rear sight assembly for a firearm. In one example, the rear sight has a sight body that includes an elevation arm connected at its distal end to the body and extending proximally therefrom to a sight portion, where the elevation arm and the body comprise a monolithic structure. A cam body is below the elevation arm and has a cam surface in contact with a bottom surface of the elevation arm, where the cam body is rotatable to change a vertical position of the sight portion.

In one example, a front sight assembly includes a sight body defining a longitudinal bore. For example, the bore extends through proximal and distal portions that extend upward from a base portion. A sight element can be retained or is disposed in the longitudinal bore. For example, the sight element is an optical fiber. A proximal end of the longitudinal bore has a reduced size so as to retain the sight element in the bore. At a distal end, a retention pin is disposed in a retention bore that extends transversely to and intersects the longitudinal bore such that the retention pin occupies a distal portion of the longitudinal bore to retain the sight element. For example, the retention bore extends vertically through a bottom surface of the sight body. The retention pin can be retained in the retention bore when the sight body is attached to a handgun slide or barrel of a firearm, for example.

The front and sights can be used together, separately, or in combination with other sight assemblies on a wide variety of host firearms, including, but not limited to semiautomatic handguns configured for duty use, concealed carry, competitive shooting, and recreation. Sight assemblies disclosed herein can similarly be used on long guns, such as rifles and shot guns, as will be appreciated.

Examples of some host firearms for the front sight and/or rear sight described herein, include the P365™, P226™, P320™, P938™ and other handguns manufactured by Sig Sauer®, Inc. Other suitable host firearms will be apparent in light of this disclosure. As will be further appreciated, the particular configuration (e.g., materials, dimensions, etc.) of the front sight and rear sight as described herein may vary, for example, depending on the intended use and particular firearm to which each sight is mounted. Numerous configurations will be apparent in light of this disclosure.

GENERAL OVERVIEW

Sights for a weapon, such as a handgun, long gun, practice gun or other device are desired to be as accurate as possible, thereby ensuring the desired point-of-impact (POI) is attained. The sights for handguns typically include a front sight and a rear sight that are used in conjunction to aim the handgun. It is an embodiment of this disclosure that the front and rear sights may be used separately or together.

Traditionally, fiber optics are placed into a sight to provide contrast between a front sight and a rear sight. These fibers are sized such that they fit into the hole in the sight body. To retain the fiber in the hole, the ends can be melted. This approach to retaining the fibers in the sights can fail and the fibers may fall out of the hole as a result. This new approach prevents loss of fiber optic and enables change of the fiber optic by the consumer.

As described herein, a front sight body is introduced that has a longitudinal bore. The proximal end of the bore has a reduced diameter so as to retain a fiber optic rod in the bore. The front of the longitudinal bore is intersected by a retention bore extending through the sight body. After the fiber optic rod is installed into the sight body, a retention pin is inserted into the retention bore of the sight body. The retention pin protrudes into the support bore, capturing the fiber optic rod or other sight element. The sight body is then attached to the slide, locking the retention pin in place. Indeed, it is an advantage that the fiber optic rod does not need to be melted to be held in the sight body. The fiber optic can also be removed and replaced without being cut, so the end user can install a different fiber optic rod if desired. For example, the user can change colors of the sight's optical fiber as desired without armorer training.

Also disclosed is an adjustable sight apparatus that has a unitary body that includes an adjustable rear sight body and an elevation arm. In one example, the elevation arm is continuous with a middle portion of the sight body and extends rearward between and separate from lateral portions of the sight body. Being made of a flexible and resilient material, the elevation arm can be displaced to adjust the vertical position of the sight portion of the rear sight assembly. For example, a cam between the top of the handgun slide and the bottom of the elevation arm can be rotated to adjust the vertical position of the elevation arm. In some embodiments, the cam body includes flats on an outer surface of the cam body. Actuation of the cam in a desired direction causes deflection of the elevation arm such that the elevation arm adjusts the rear sight body.

As discussed herein, terms referencing direction, such as upward, downward, vertical, horizontal, left, right, front, back, etc., are used for convenience to describe embodiments of firearm sights aligned horizontally. Embodiments of the present disclosure are not limited by these directional references and it is contemplated that the disclosed sights could be used in any orientation.

The following examples illustrate particular properties and advantages of some of the embodiments of the present disclosure. The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Example Embodiments

FIG. 1 shows a perspective view of a handgun 100, in accordance with an embodiment of the present disclosure. The handgun 100 contains a grip module 102 preferably consisting of a suitable polymeric material, metal, or composite, and which includes a grip portion 104, a trigger guard 112, and an upper module portion 111 that accommodates a receiver (not visible). A slide 128 is mounted to the receiver and can reciprocate longitudinally along the barrel 110 and receiver during use. An ejection opening 126 for the spent cartridges (not shown) is also provided on the side of the slide 128.

Also as shown in FIG. 1, a rear sight 120 and a front sight 122 are mounted to the top of the slide 128. The rear sight 120 and front sight 122 may be an integral part of the slide 128 or, alternatively, can be separate, optionally replaceable parts. The slide 128 provides a substrate on which to attach various accessories. For example, a rear sight 120 and a front sight 122 will often be placed at or proximate to a rear (proximal) portion of the slide and at or proximate to a forward (distal) portion of the slide 128, respectively. Alignment of the rear sight 120 and front sight 122 provide a useful system to aim the handgun 100.

The front sight 122 and rear sight 120 are described in more detail below. The front sight 122 and rear sight 120 may be used together, as shown and described herein; however, for illustration purposes, the front sight 122 and rear sight 120 will be described using associated figures. Additionally, the front sight 122 and rear sight 120 can be used or provided individually or together as part of a complete handgun, as part of a slide assembly, or as replacement parts for a firearm. Further, while described in the context of a handgun, the front sight 122 and rear sight 120 can be used with other types of firearms, including rifles and shotguns. Numerous variations and embodiments will be apparent in light of the present disclosure.

Front Sight

Figure 2:
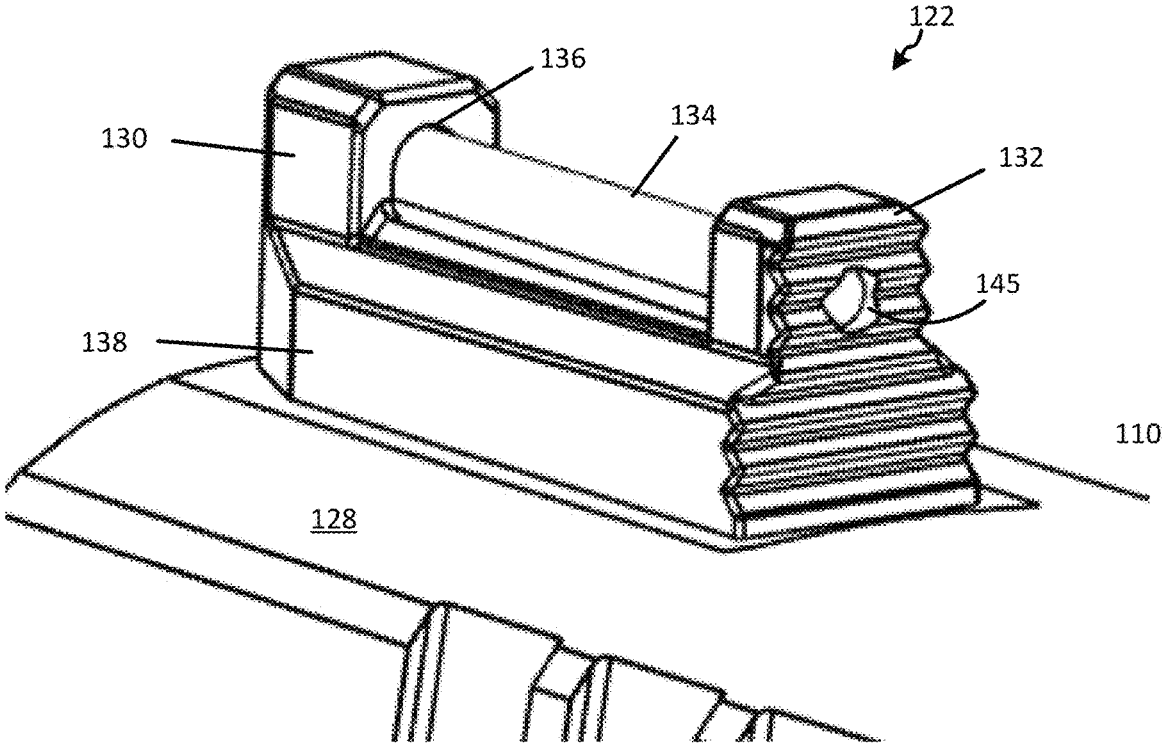
FIG. 2 shows a rear perspective view of a front sight mounted on a handgun slide according to an embodiment of this disclosure.

FIG. 2 shows a rear perspective view of front sight 122 mounted to a handgun slide 128. The front sight 122 includes a base 138, or support portion, which is attached to slide 128. The front sight 122 has a proximate portion 132, which is closer to the user, and a distal portion 130 that is further away from the user. The distal portion 130 is disposed at a distal location closer to the muzzle of the handgun 100, as shown in FIG. 1. The proximate portion 132 and distal portion 130 each may be a molded housing structure that is formed to support, or hold a sight element 134, such as a filament, or fiber. As described herein the proximal portion 132 may be referred to as proximate housing, proximate support, and/or front portion.

As described herein the distal portion 130 may be referred to as a distal housing, a distal support, or a front portion. The proximal portion 132 may be referred to as a proximal housing, a proximal support, or a rear portion. In this example, the distal portion 130 and proximal portion 132 extend up from the base 138. Base 138 can also be referred to as a support portion or sight body. An orifice, or hole, also referred as a support bore or longitudinal bore 136, is formed through the distal portion 130 and through the proximal portion 132. The support bore or longitudinal bore 136 of proximal portion 132 may be used to hold or support a sight element 134. In some embodiments, the longitudinal bore 136 is also formed in part in the base 138, such as defining an open channel along the top of the base 138 between the distal portion 130 and the proximal portion 132. In yet other embodiments, part of the longitudinal bore 136 extends through the base 138 and can be closed along its length, such as when the sight element 134 does not use ambient light. In some embodiments, part of the longitudinal bore 136 between the proximal portion 132 and distal portion 130 may be semi-circular in shape, or trough-shaped, with an open upper region, such that the upper half of the sight element 134 is exposed to ambient light when installed. For example, the longitudinal bore 136 may have a "half-pipe" design between the proximal housing 132 and distal housing 130.

A sight element 134, such as a length of material, a fiber, a filament, a fiber optic rod, or self-luminous tube, for example, can be retained in the longitudinal bore 136 that passes through the proximal portion 132 and the distal portion 130. Part of the sight element 134 may be exposed to ambient light for the purpose of illuminating the proximal end of the sight element 134. For example, a top surface and portions of side surfaces of sight element 134 can be exposed to the ambient light either directly or via a translucent cover (not shown). The sight element 134 may have properties that allow the sight element 134 to collect and direct ambient light to illuminate an end the sight element 134 that is visible to the user through the proximal end of the longitudinal bore 136. This enhances the ability of a user to see the front sight 122.

Figure 3:
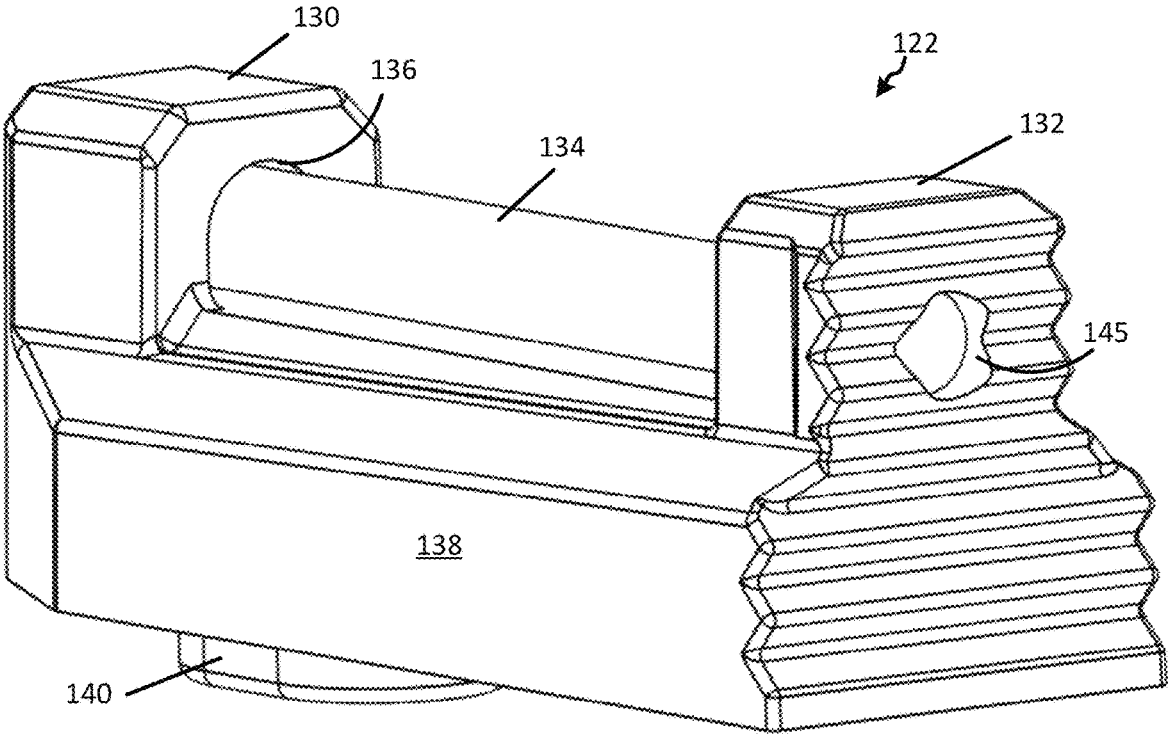
FIG. 3 shows an enlarged rear perspective view of a front sight according to an embodiment of this disclosure.

FIG. 3 shows an enlarged rear perspective view of front sight 122. The front sight 122 includes a lower mounting protrusion 140 disposed at the lower side of the base 138. The longitudinal bore 136 in the proximate portion 132 has a distal portion of a first diameter 143 sized to accommodate the optical fiber, and a proximal portion of a second diameter 145 of reduced size (e.g., that is smaller than the optical fiber) so as to capture the optical fiber in the longitudinal bore 136. The other elements of FIG. 3 have been described in relation to FIG. 2.

Figure 4:
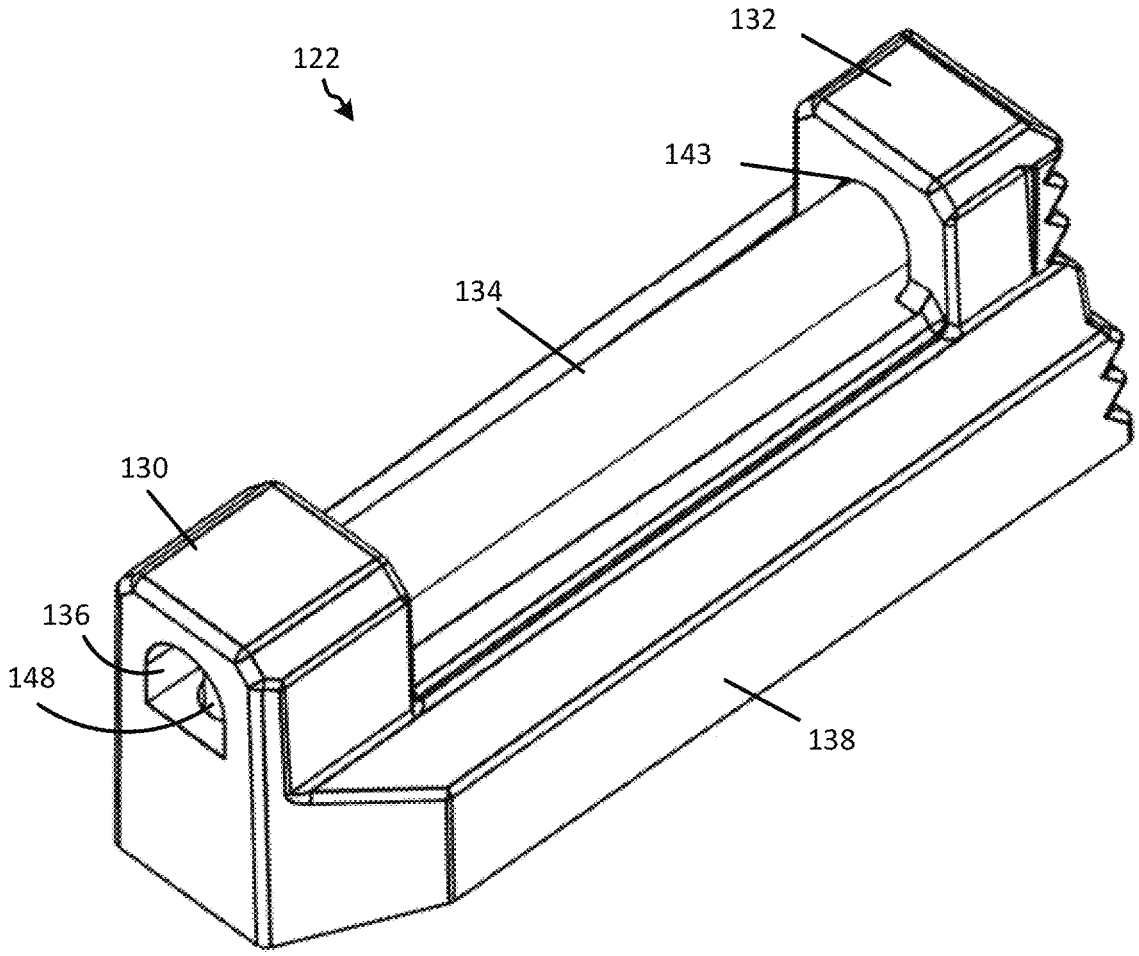
FIG. 4 shows a top and front isometric view of a front sight according to an embodiment of this disclosure.

FIG. 4 shows a top and front isometric view of front sight 122. A retention pin 148 is shown in the longitudinal bore 136 through distal portion 130 of front sight 122. The retention pin 148 can be a fastener, a roll pin, a fiber optic rod, a dowel pin, or other suitable retention device. Sight element 134, proximate portion 132 and base 138 are shown. The longitudinal bore 136 through the proximal portion 132 has a first diameter 143 and a second diameter portion 145 of reduced diameter, which is at the proximal end of proximal portion 132. The first diameter portion 143 of orifice 142 has an associated diameter and the second diameter portion 145 has an associated diameter.

Figure 5:
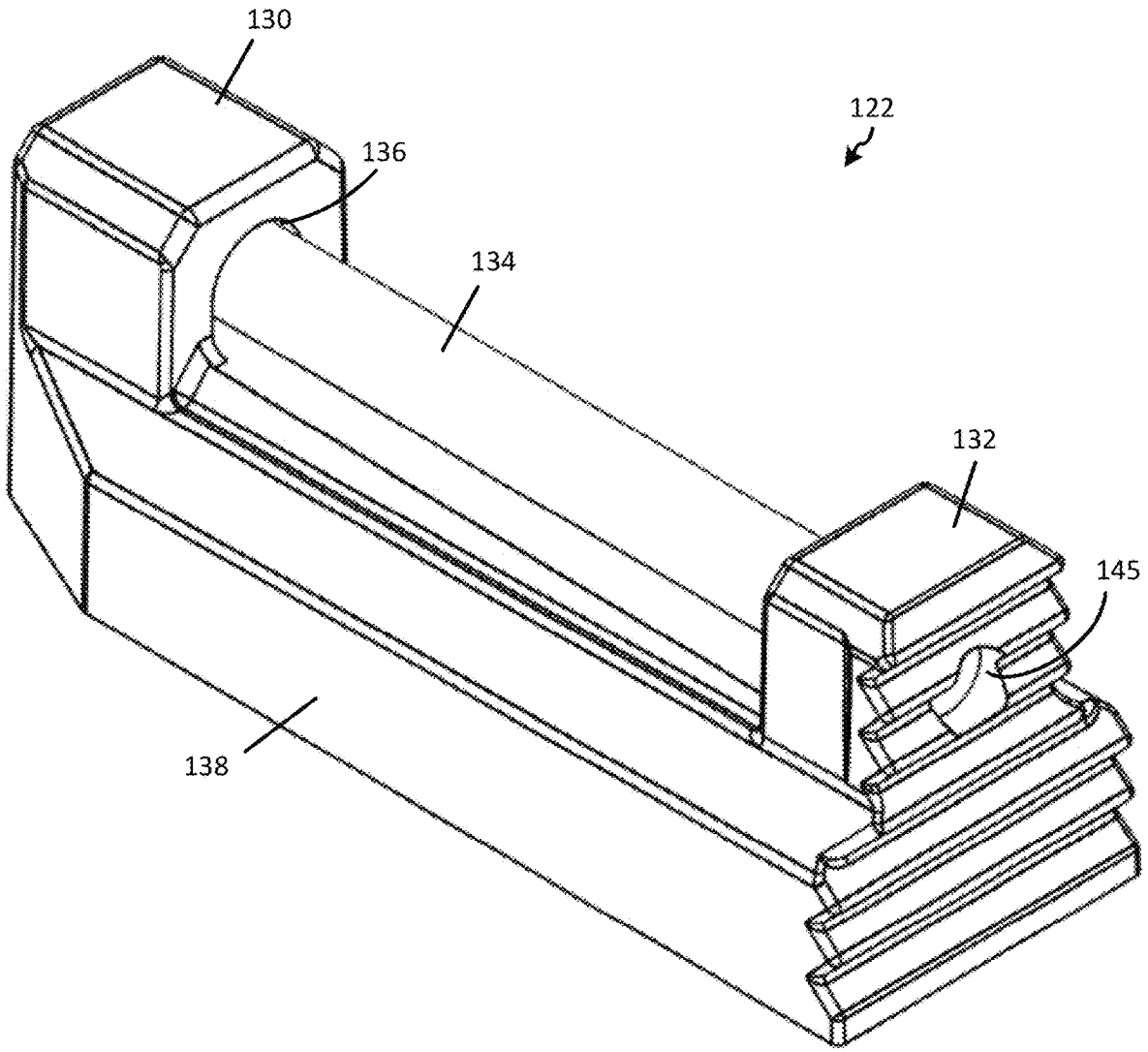
FIG. 5 shows a top rear isometric view of a front sight according to an embodiment of this disclosure.

FIG. 5 shows a top and rear isometric view of front sight 122. The distal portion 130 defines part of the longitudinal bore 136 to receive part of the sight element 134, which may be a fiber optic or self-luminous tube, for example. The distal portion 130 and proximal portion 132 are supported by base 138. In the example shown, the distal portion 130, proximal portion 132, and base 138 are formed as a single structure with the distal portion 130 and proximal portion 132 extending up from the base 138 in a longitudinally spaced arrangement.

Figure 6:
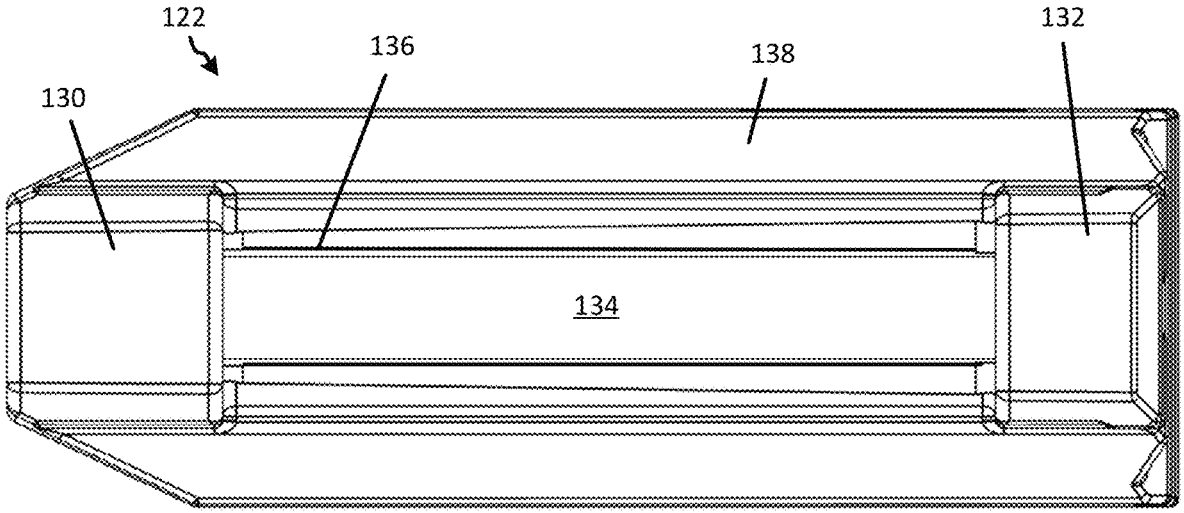
FIG. 6 shows a top plan view of a front sight according to an embodiment of this disclosure.

FIG. 6 shows a top plan view of front sight 122. Distal portion 130, proximal portion 132, sight element 134 and base 138 are shown. Part of the sight element 134 (e.g., an optical fiber) is exposed to ambient light in the trough-like portion of the longitudinal bore 136 between distal portion 130 and proximal portion 132.

Figure 7:
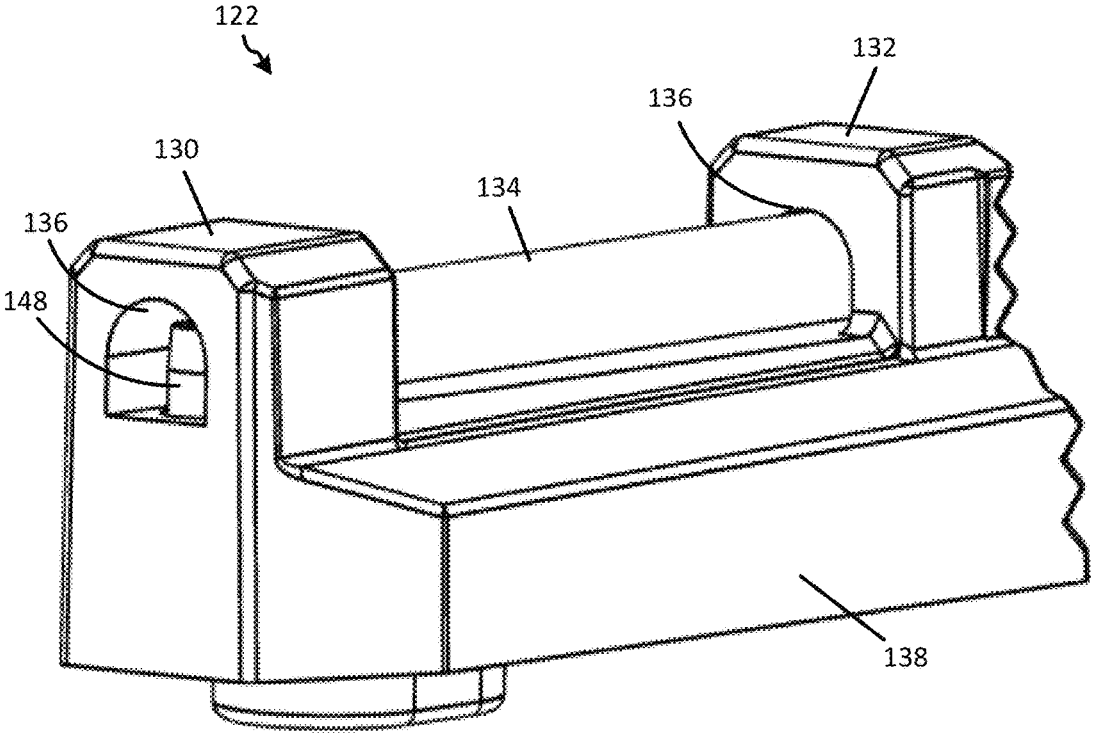
FIG. 7 shows a front perspective view of a front sight according to an embodiment of this disclosure.

FIG. 7 shows a front perspective view of front sight 122. As shown in FIG. 7, the longitudinal bore 136 through the distal portion 130 has part of a retention pin 148 disposed therein. The retention pin 148 prevents the sight element 134 from passing beyond the end of distal portion 130. Thus, the reduced diameter portion of the longitudinal bore 136 in the proximal portion and the retention pin 148 occupying part of the longitudinal bore 136 in the distal portion 130 retains the sight element 134 in a desired position. Protrusion 140 extends from a lower surface of base 138 and can be received in a corresponding recess in the top surface of the handgun slide 128 (or other top portion of a firearm). Proximal portion 132 is also shown.

Figure 8:
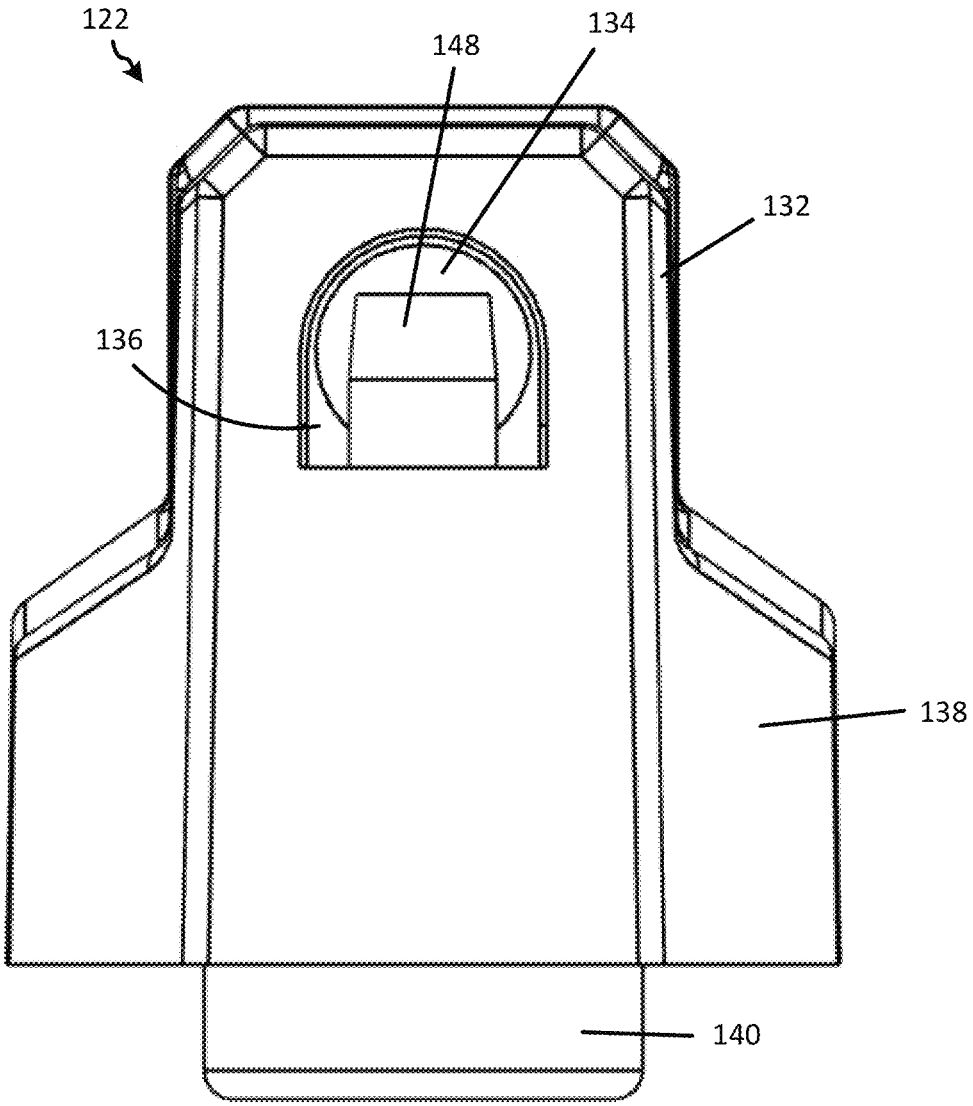
FIG. 8 shows a front elevational view of a front sight according to an embodiment of this disclosure.

FIG. 8 shows a front elevational view of distal portion 130 of the front sight 122. Longitudinal bore 136 and a portion of the sight element 134 are shown in distal portion 130. The base 138 and protrusion 140 are also shown. In some embodiments, the sight element 134 is slightly smaller than longitudinal bore 136 so as to freely pass through the longitudinal bore 136. In other embodiments, the sight element 134 can be sized for a frictional fit in the longitudinal bore 136. An upper portion of retention pin 148 is shown occupying part of the longitudinal bore 136, preventing the sight element 134 from escaping the longitudinal bore 136.

Figure 9:
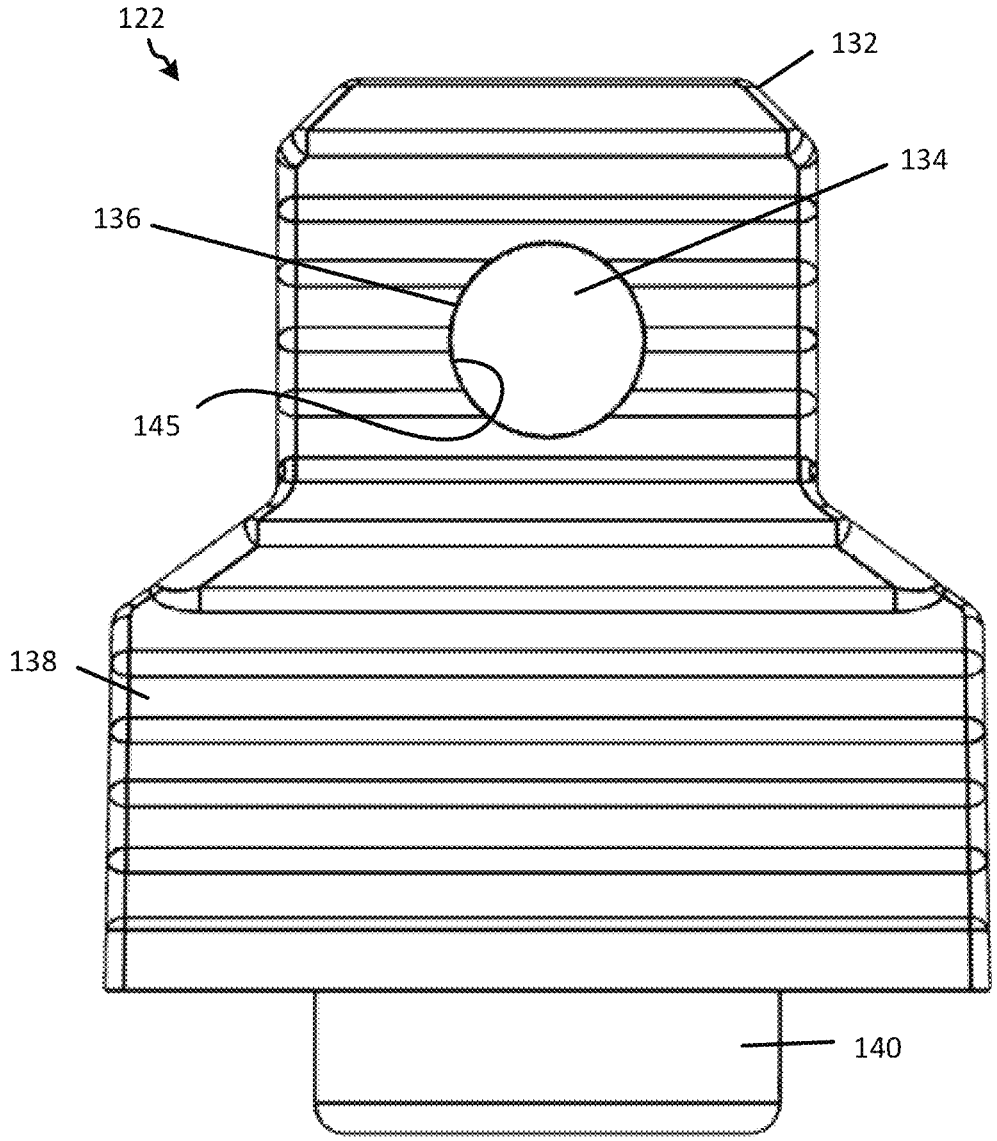
FIG. 9 shows a rear elevational view of a front sight according to an embodiment of this disclosure.

FIG. 9 shows a rear elevational view of the front sight 122. The sight element 134 is visible through the second diameter portion 145 of the longitudinal bore 136 of the proximal portion 132. The base 138 and mounting protrusion 140 are also shown. As viewed in FIG. 9, part of the longitudinal bore 136 has a diameter that is smaller than a diameter of the sight element 134, allowing an end of the sight element 134 to be visible to the user while also preventing the sight element 134 from escaping. Mounting protrusion 140 is also shown.

Figure 10:
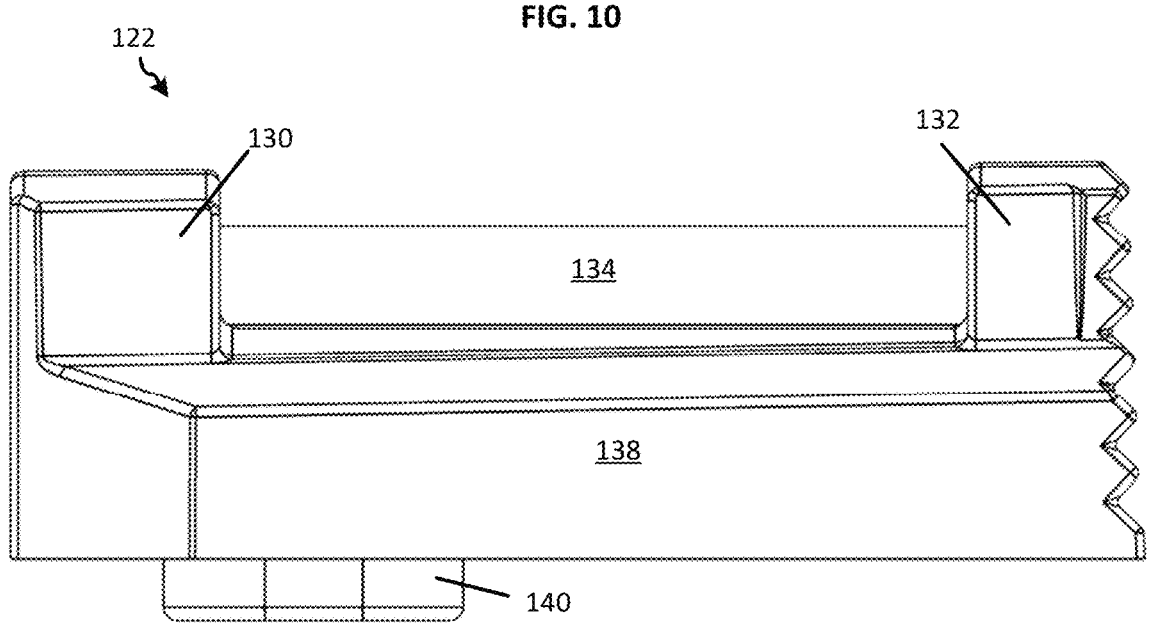
FIG. 10 shows an elevational view of the left side of a front sight according to an embodiment of this disclosure.

FIG. 10 shows an elevational view showing the left side of front sight 122. Distal portion 130, proximal portion 132, sight element 134, base 138, and mounting protrusion 140 are shown.

Figure 11:
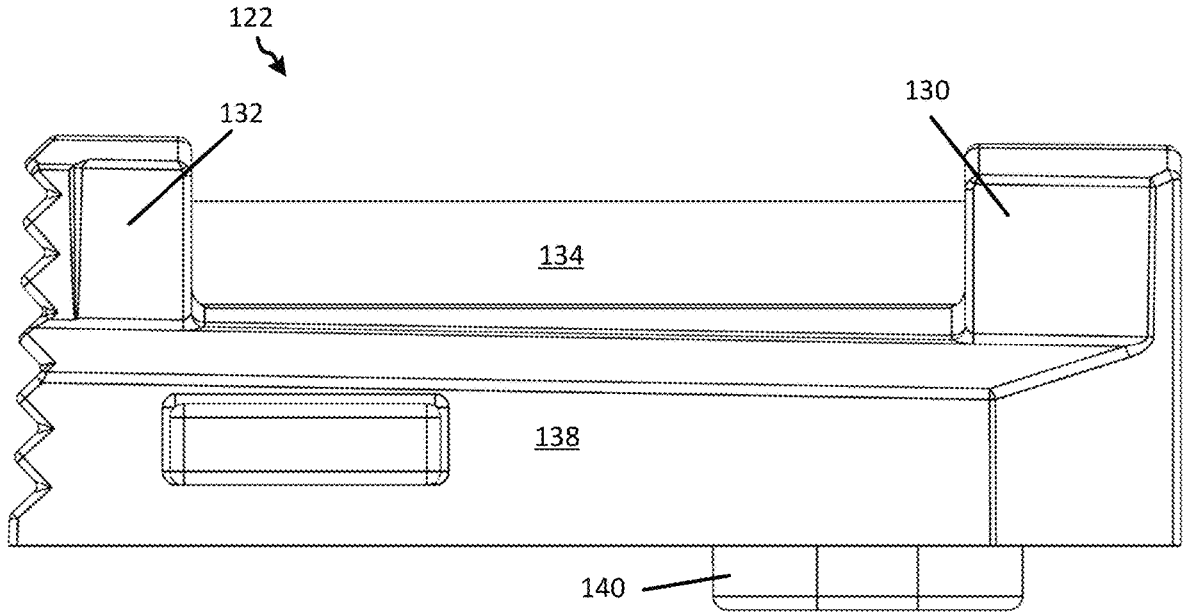
FIG. 11 shows an elevational view of the right side of a front sight according to an embodiment of this disclosure.

FIG. 11 shows an elevational view showing the right side of front sight 122. Distal portion 130, proximal portion 132, sight element 134, base 138, and mounting protrusion 140 are shown.

Figure 12:
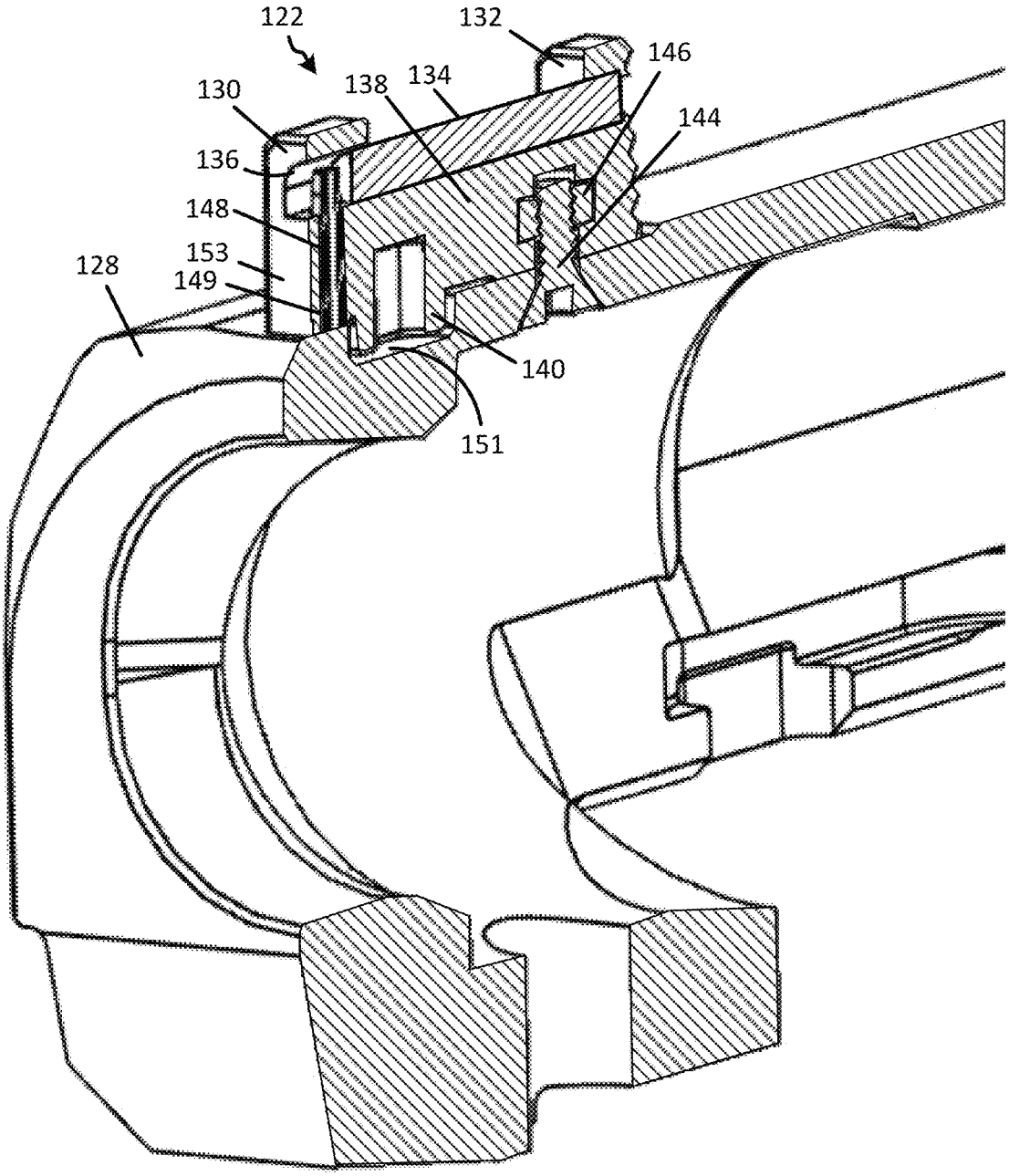
FIG. 12 shows a longitudinal section of a front sight mounted to a slide of a handgun according to an embodiment of this disclosure.

FIG. 12 shows a longitudinal section of a front sight 122 mounted to a slide 128 of a handgun 100 according to an embodiment of this disclosure. The front sight 122 includes a distal housing or distal portion 130 and a proximal housing or proximal portion 132 extending up from base 138, which is mounted to slide 128. The front sight 122 includes fastener 144 (e.g., screw) engaging a nut 146 housed in the base 138. Mounting protrusion 140 fits into and is received in a groove or recess 151 in a top surface of slide 128. The sight element 134 is received in and retained in the longitudinal bore 136 through the front sight 122.

Retention pin 148 is disposed in a retention bore 149. The retention pin 148 is retained in the retention bore 149 between the slide 128 and the closed top of the distal portion 130 of the front sight 122. The retention bore 149 is oriented in any suitable direction and houses retention pin 148. The retention pin 148 occupies part of the longitudinal bore 136 in the distal portion 130 of the front sight 122, such that the sight element 134 is prevented from escaping from the front of front sight 122. The retention bore 149 may be any suitable design configuration, such as horizontal, vertical, diagonal, or any suitable angle. In the example shown, the retention bore 149 extends through a bottom surface of the distal portion 130 of the front sight 122 and intersects the longitudinal bore 136. In other embodiments, the retention bore 149 and retention pin 148 could extend through a side or top of the distal portion 130. In an alternate embodiment, the retention bore 149 may be at any angle on the distal portion 130. While a vertical orientation is shown, it is envisioned that a suitable screw, which may be counter-sunk into distal portion 130, could be used to hold retention pin 148 in an orientation that is other than vertical.

The retention pin 148 is disposed such that the retention pin 148 at least partly blocks the longitudinal bore 136 to retain the sight element 134 therein. Indeed, the position of retention pin 148 in retention bore 149 prevents the sight element 134 from extending beyond the front surface 153 of distal portion 130. The retention pin 148 can be a roll pin, a fastener, a length of fiber optic rod, a dowel pin, or other structure that is received in the retention bore 149. The retention bore 149 can be a smooth bore or threaded as appropriate for the corresponding retention pin 148. In one example, the retention bore 149 is threaded and the retention pin 148 is a set screw or similar fastener.

Figure 13:
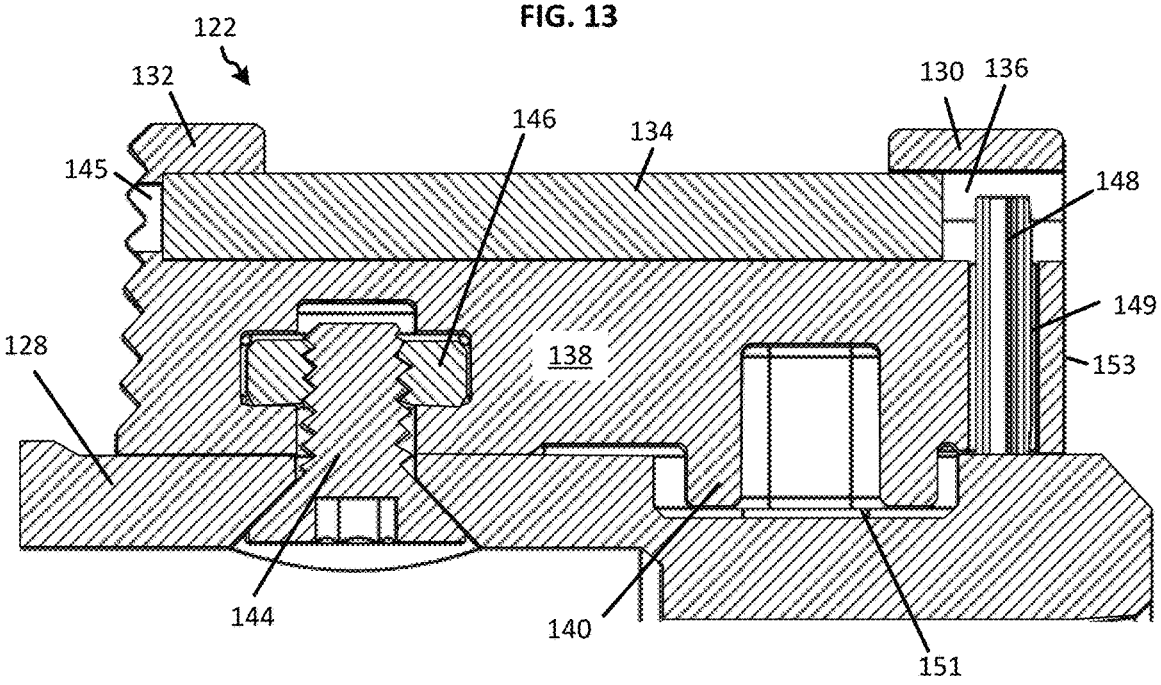
FIG. 13 shows a side sectional view of a front sight mounted to a slide of a handgun according to an embodiment of this disclosure.

FIG. 13 shows a side sectional view of front sight 122 mounted to a slide 128. The front sight 122 includes a base 138 a captured threaded nut 146. The base 138 is mounted on the slide 128 using fastener 144 extending upward through the slide 128 and into the nut 146. Alternately, the fastener 144 can engage a threaded fastener bore in the base 138. The protrusion 140 is received in a recess 151 defined in the top of slide 128. The front sight 122 includes distal portion 130 with associated portion of longitudinal bore 136. A distal portion of the sight element 134 fits into longitudinal bore 136 and the sight element 134 abuts, contacts, or otherwise is blocked by the retention pin 148 from passing through the distal end of the longitudinal bore 136. The retention pin 148 is housed in the retention bore 149, which intersects the longitudinal bore 136. The retention pin 148 is sized so as to occupy the longitudinal bore 136 when a lower end of the retention pin 148 is on the top of the slide 128, for example. As such, the position of retention pin 148 in retention bore 149 prevents sight element 134 from extending beyond the front surface 153 of distal portion 130.

The front sight 122 also includes proximal portion 132 with associated portion of the longitudinal bore 136. The sight element 134 is retained in the longitudinal bore 136 in part by the reduced second diameter 145 at the proximal end of the longitudinal bore 136 in the proximal portion 132. Thus, the sight element 134 is retained at proximal and distal ends (as shown by distal portion 130 and proximal portion 132) to prevent loss of the sight element 134.

As discussed above, the longitudinal bore 136 in the distal portion 130 is intersected by a retention bore 149 extending through the bottom of the base 138. The retention pin 148 protrudes into the longitudinal bore 136 in the distal housing or distal portion 130 to obstruct the sight element 134 from sliding out of the longitudinal bore 136. The front sight 122 can then be attached to the slide 128, locking the retention pin 148 in place. In doing so, the retention pin 148 can but need not engage the retention bore 149; in other words, the retention pin 148 can be loosely retained in the retention bore 149 between the slide and the closed upper end of the retention bore 149.

Rear Sight

The rear sight 120, as described herein, uses a one-piece sight body 152 that acts as a support for the rear sight and that includes an adjustable elevation arm 168. A cam 188 between the elevation arm 168 and the slide 128 can be moved to deflect the elevation arm 168 away from the slide 128 in varying amounts for the purpose of adjusting a vertical position of the aiming portions of the rear sight.

Figure 14:
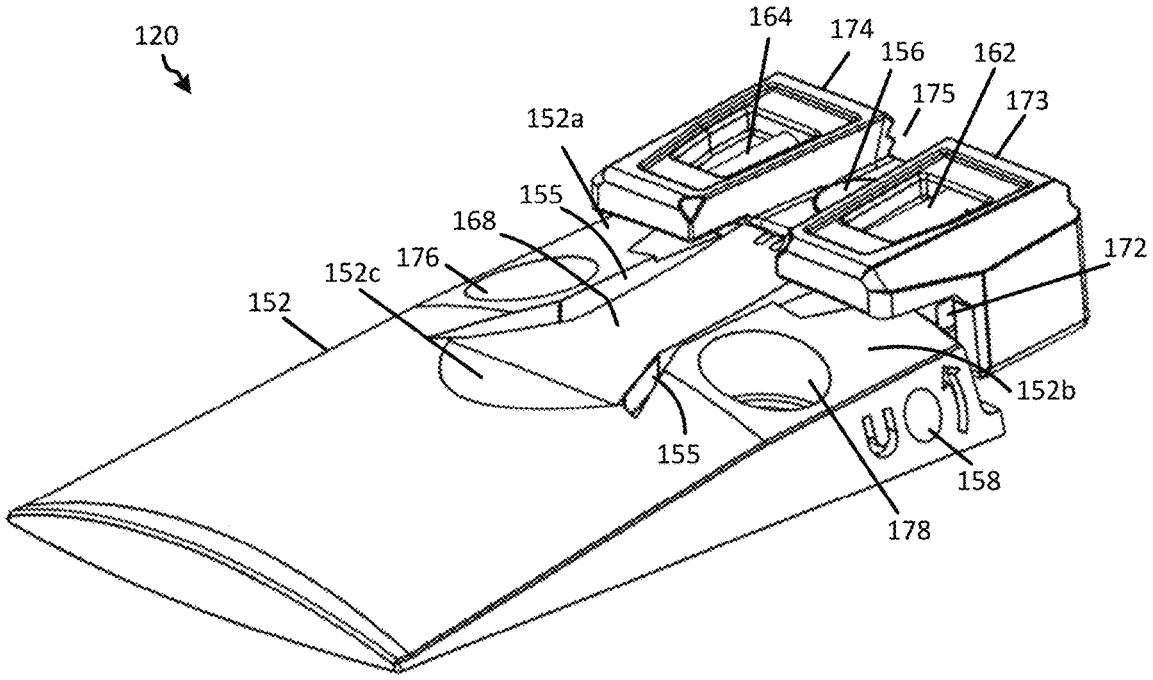
FIG. 14 shows a front and top perspective view of a rear sight according to an embodiment of this disclosure.

FIG. 14 shows a front and top perspective view of a rear sight 120, in accordance with an embodiment of the present disclosure. The rear sight 120 has a substantially wedge-shaped body 152 that includes an elevation arm 168 that extends rearwardly to a sight portion 172. The elevation arm 168 and body 152 are portions of a single, monolithic structure where the elevation arm 168 can bend due to the properties of the material. For example, the body 152 and elevation arm 168 are made of a flexible and resilient material, such as a polymer. In accordance with some embodiments, the elevation arm 168 and body 152 define a living hinge that enables vertical adjustment of a sight portion 172 at the end of the elevation arm 168.

The term "living hinge" may refer to a flexure bearing made from a single piece of material that connects two bodies of the same material. A rear sight 120 assembly according to the present disclosure includes a body 152 made as a single piece of material that includes an elevation arm 168. The elevation arm can 168 bend with respect to the body 152 due to the flexibility and resiliency of the material. In one embodiment, the elevation arm 168 extends between lateral portions 152*a*, 152*b* of the body 152 such that the elevation arm is free-floating along its length with respect to lateral portions 152*a*, 152*b*. In some embodiments, the rear sight 120 may operate by bending the material of the elevation arm 168. For example, the thickness and other dimensions of the body 152 and the elevation arm 168 can be selected to provide the desired flexibility, range of motion, and resilient force to resume a resting position. In some embodiments, the elevation arm 168 can be thinned or scored along its length and/or at specific locations, such as adjacent the junction between the elevation arm 168 and the body 152, to increase flexibility and/or to promote bending at a desired hinge point.

A plastic living hinge may be manufactured by an injection molding operation that forms the parts in a single piece. It is contemplated that a living hinge between elevation arm 168 and body 152, as described herein may be formed by injection molding of materials comprising polyethylene, polypropylene, nylon, glass-reinforced nylon, or other flexible and resilient materials. Properties of the living hinge are related to the properties of the material and dimensions (e.g., length, thickness) of the elevation arm 168, for example.

Elevation arm 168 is shown as a sloped, longitudinal portion of body 152. Any suitable design of elevation arm 168 is within the scope of this disclosure. The elevation arm 168 can be deflected using a cam 188 to change the elevation of sight portion 172, and to also change the elevation of aiming portions 173 and 174 (when present) such that a user can adjust the sight picture of the firearm as required for accurate shooting. This aiming typically includes alignment of aiming portions 173 and 174 with a front sight, such as front sight 122 as described herein.

In the example shown, the body 152 defines fastener orifices 176 and 178 through lateral portions 152*a*, 152*b*, respectively, which can be used for mounting the rear sight 120 to the top of a handgun slide 128 using fasteners. The rear sight 120 can similarly be mounted to the top of a receiver, barrel, or other top surface of a firearm. The elevation arm 168 is connected to a middle portion 152*c* of the body 152 and extends rearwardly between lateral portions 152*a*, 152*b* to a sight portion 172. The elevation arm 168 is spaced from and is discontinuous with each lateral portion 152*a*, 152*b* along longitudinal gaps 155 so as to be free floating with respect to the lateral portions 152*a*, 152*b* of the sight body 152. The elevation arm 168 and sight portion 172 can have a T-shape in some embodiments. As shown, the sight portion 172 includes left and right aiming portions 173, 174 attached to the sight portion 172. The left and right aiming portions 173, 174 extend above the top surface of the elevation arm 168 and define a gap or sight opening 175 between them. For example, the aiming portions 173, 174 and top surface of the elevation arm 168 define a rectangular channel through which the user can view the front sight 122. In other embodiments, the sight portion 172 defines or includes aiming portions 173, 174 as an integral part of the sight portion 172 rather than as separate components. For example, the sight portion 172 defines a U-shaped channel through which the front sight 122 is visible when aiming the gun.

A cam 188 (not visible; shown in FIG. 22) positioned between the elevation arm 168 and the top surface of the firearm (e.g., top surface of slide 128) can be rotated or moved to deflect the elevation arm 168 upward in varying amounts (away from the slide 128), and in turn to adjust the vertical position of aiming portions 173, 174. The cam 188 can be rotated, for example, by engaging an end of the cam 188 with a tool through opening 158 or opening 160 defined in the side of the body 152. In other embodiments, a knob can be attached to or made as part of the cam 188 that is accessible to the user on the outside of the body 152. Thus, rotation of the knob may move or rotate the cam 188 in a desired direction to cause the desired deflection of the elevation arm 168.

In one embodiment, the cam 188 has a generally cylindrical shape with a cam surface that is eccentric about the axis of rotation. Accordingly, rotating the cam 188 with the cam surface in contact with the bottom of the elevation arm 168 causes a greater or smaller distance between the elevation arm 168 and the axis of rotation of the cam 188, therefore resulting in the desired deflection of the elevation arm 168 to adjust the height of the sight portion 172. The amount of deflection of elevation arm 168 is based, at least in part, on the length of the elevation arm 168, position of the cam 188 along the elevation arm 168, amount of cam rotation, and profile of the cam surface, for example. In other embodiments, the cam 188 can be a wedge that slides laterally or longitudinally between the elevation arm 168 and the firearm. For example, the wedge-shaped cam can be advanced or retracted using a screw-drive accessible from the side or proximal end of the rear sight 120.

Aiming portions 173 and 174 form part of a sight picture that can include the front sight 122, as described herein, to aim the handgun. In some embodiments, each aiming portion 173, 174 defines a cavity in which an associated sight element 162, 164 can be housed. Specifically, sight element 162 is housed in left aiming portion 173 and sight element 164 is housed in right aiming portion 174. For example, sight elements 162, 164 can be an optical fiber exposed to ambient light along at least part of its length. In other embodiments, sight elements 162, 164 can be or can include a self-luminous tube, such as a tritium vial. In yet other embodiments, sight elements 162, 164 can be or include aiming indicators (e.g., a dot or square) of reflective or high-visibility material, of other suitable material on the rear face of the aiming portions 173, 174, for example. In some embodiments, aiming portions 173, 174 can use a combination of a fiber optic rod, a self-luminous tube, and high-visibility material. In some embodiments, the aiming portions 173, 174 alternately or additionally can include a dot, tritium vial, reflective surface, or other indicator that is visible to the user at least in lighted conditions. As will be appreciated, when sight elements 162, 164 are optical fibers, the exposed portion of the sight elements 162, 164 can contribute to the apparent brightness of the rear sight 120 in daylight or other lighted conditions.

In some embodiments, the sight portion 172 at the proximal end of the elevation arm 168 is configured as an attachment point for aiming portions 173, 174. In one example, the sight portion 172 extends crosswise to, and defines a T with, the longitudinal portion of the elevation arm 168. In some such embodiments, the aiming portions 173, 174 can be attached individually or as a single assembly to the sight portion 172 using a snap fit, a fastener, or other suitable method.

Fastener orifices 176 and 178 are designed to provide a via for fasteners 177, 179 (not visible) to attach the rear sight 120 to a slide 128. For example, the fastener openings 176, 178 can be threaded or smooth bores configured to receive corresponding fasteners 177, 179 that are arranged to accommodate the desired hole pattern in the slide 128. In embodiments where machine screws or other fasteners (e.g., 177, 179) are used to secure the rear sight 120, the fasteners 177, 179 can extend vertically through the rear sight 120 at fastener openings 176, 178.

In some embodiments, the aiming portions 173, 174 are adjustably mounted to the sight portion 172 of the elevation arm 168, such as for windage adjustment. Right/left adjustment can be actuated with an Allen wrench, hex wrench, a screwdriver, or other suitable tool adjusting a position of the rear sight 120. Opening 156 may receive a fastener that is part of the right/left adjustment.

In one embodiment, a windage blade (visible to user) holds the sight elements 162, 164, which may be, for example, a fiber optic. For example, fiber optic cords are clamped between the body of the aiming portion 173, 174 and the sight portion 172 of the elevation arm 168. In other embodiments, sight element 162 is disposed in a bore defined in left aiming portion 173 and sight element 164 is disposed in a bore defined in right aiming portion 174. Sight elements 162, 164 can be a fiber, a fiber optic rod, a self-luminous tube, or other suitable material. Typically, the sight elements 162, 164 of the rear sight 120 will be of the same color, and that color will be different than the sight element 134 of the front sight 122. The use of different color fibers between the front sight and rear sight enhances contrast and improves the ability for a user to properly align the front and rear sight for aiming, but the use of different colors is not required.

Figure 15:
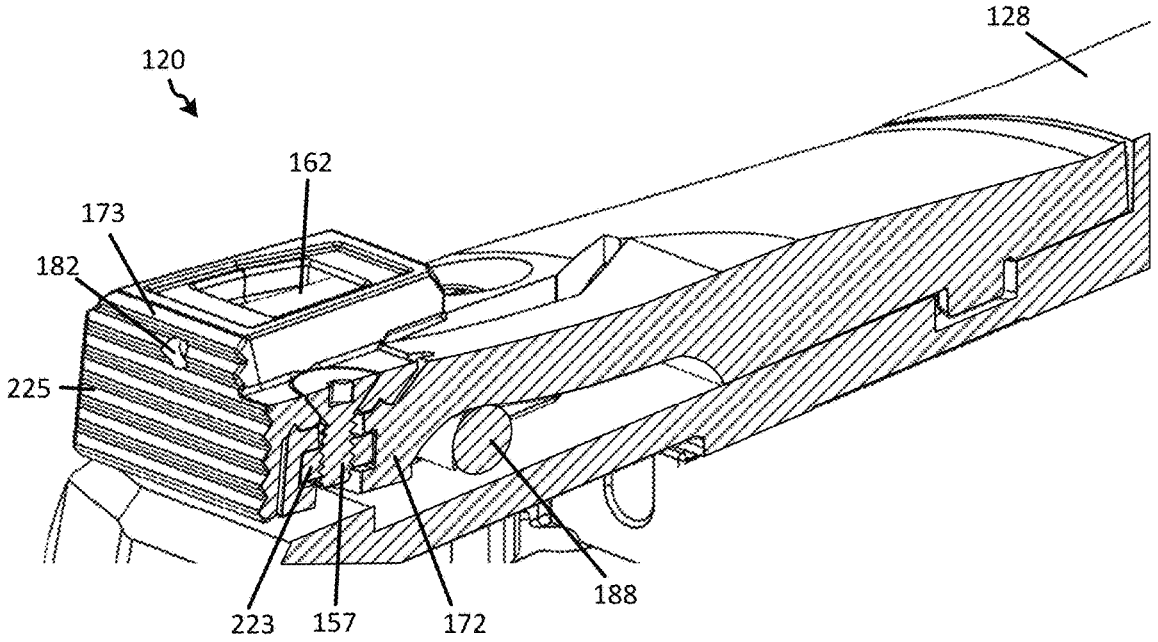
FIG. 15 shows a rear, perspective, cross-sectional view of a rear sight according to an embodiment of this disclosure.

FIG. 15 shows a perspective view of a longitudinal sectional taken through the elevation arm 168 of the rear sight 120, where the rear sight 120 is installed on a handgun slide 128. As noted above, the rear sight 120 includes aiming portion 173 attached to sight portion 172 with fastener 157. Sight element 162 is retained in a bore defined axially through the left aiming portion 173 with a portion of the sight element 162 exposed to ambient light. An end of the sight element 162 is visible to the user through bore opening 182 on the proximal face 225 of aiming portion 173. Opening 156 is shown with fastener 157 that engages a threaded nut 223 captured in a cavity defined in the sight portion 172 of the elevation arm 168. Tightening the fastener 157 fixes the lateral position of aiming portions 173, 174 (only 173 is shown in FIG. 15). Similarly, fastener 157 can be loosened to adjust the lateral position of aiming portions 173, 174. Cam 188 is between elevation arm 168 and top surface of slide 128. As noted above, rotation of cam 188 deflects elevation arm 168 to varying amounts.

Figure 16:
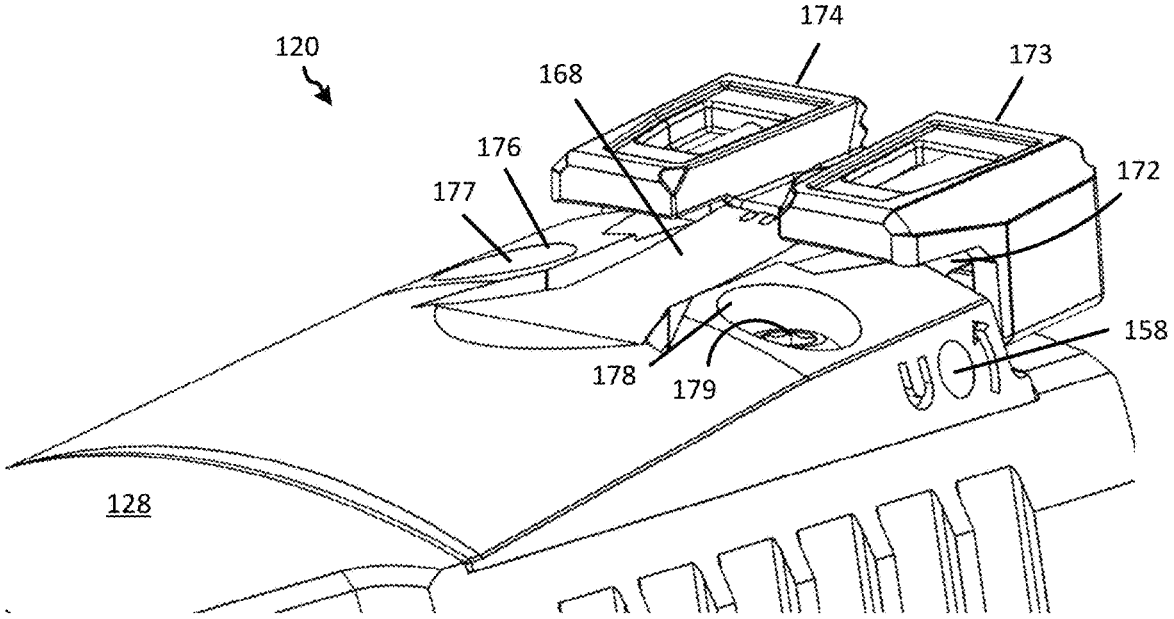
FIG. 16 shows a front perspective view of a rear sight installed on a handgun slide according to an embodiment of this disclosure.

FIG. 16 shows a front perspective view of rear sight 120 installed on a handgun slide 128. Rear sight 120 is secured to the slide 128 using fasteners 177, 179 installed through orifices 176, 178. The aiming portions 173, 174 are affixed to sight portion 172 of the elevation arm 168. The cam 188 (not visible) can be adjusted by engaging the end of the cam with a tool inserted into opening 158 on the side of the sight body 152. The other elements shown in FIG. 16 have been described in relation to FIG. 15.

Figure 17:
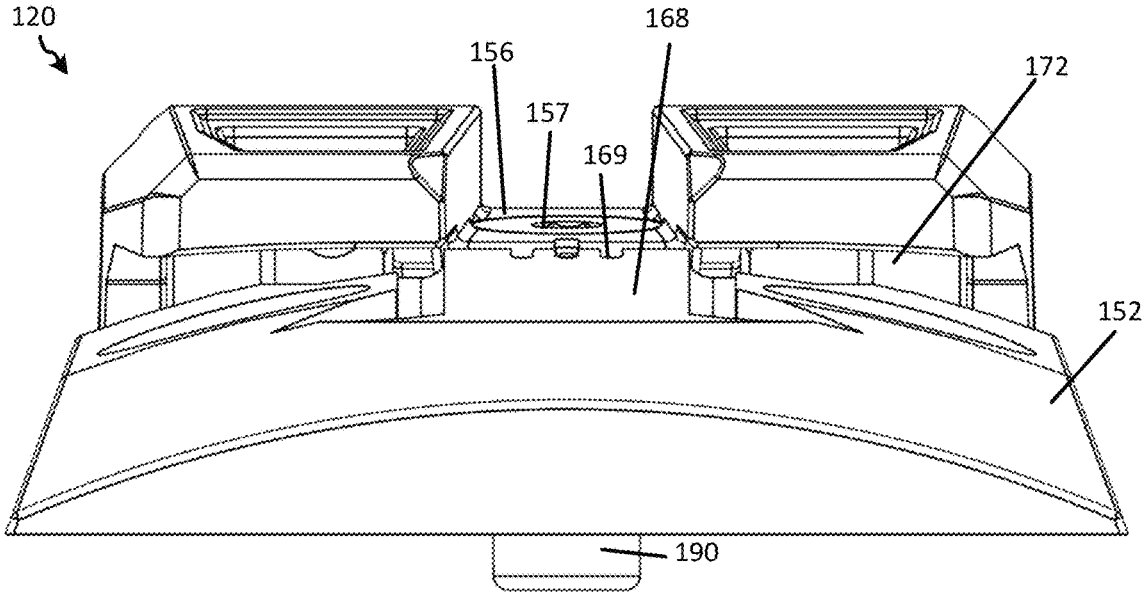
FIG. 17 shows a front view of a rear sight according to an embodiment of this disclosure.

FIG. 17 shows a front view of rear sight 120. Sight body 152 with elevation arm 168 is shown. A fastener 157 is received in fastener opening 156 to secure the aiming portions 173, 174 to the sight portion 172 and for windage adjustment. A protrusion 190 extends from the bottom of the sight body 152 and can be received in a corresponding recess in the top of the handgun slide 128 for desired placement of the rear sight 120. Elevation arm 168 includes indicia 169 to facilitate windage adjustment, as will be appreciated.

Figure 18:
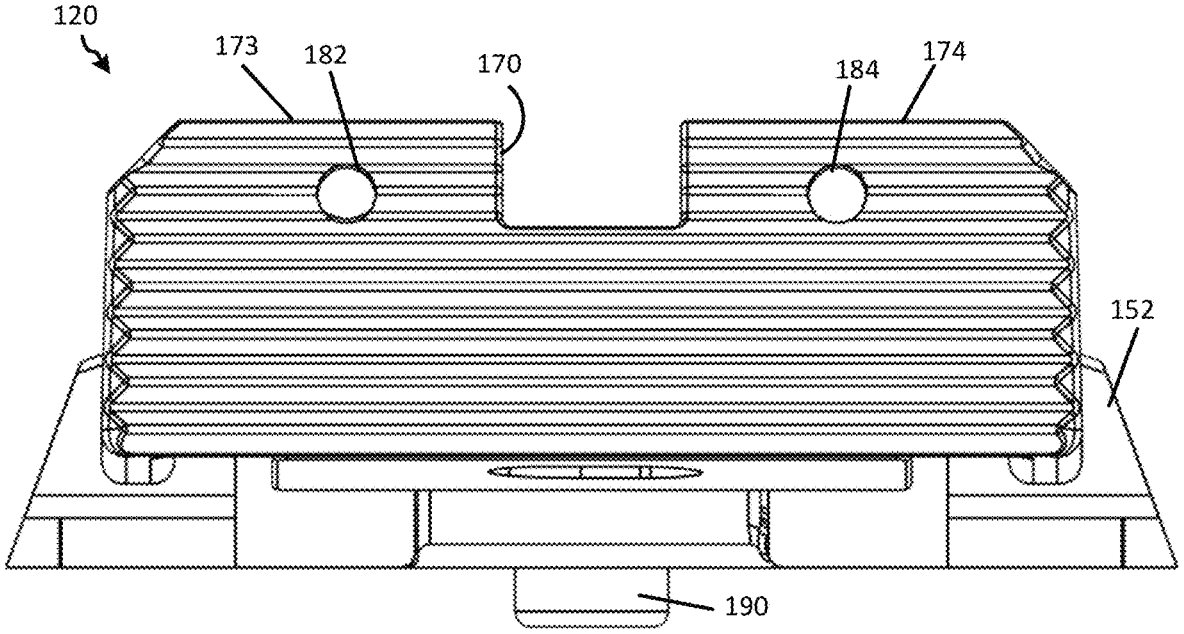
FIG. 18 shows a rear view of a rear sight according to an embodiment of this disclosure.

FIG. 18 shows a rear view of the rear sight 120. Aiming portions 173 and 174 have associated orifices 182 and 184, respectively. Sight elements, such as optical fiber, is visible to the user through orifices 182, 184. Protrusion 190 on the lower surface of body 152 are also shown. The aiming portions 173, 174 are part of a monolithic aiming assembly that generally defines a U-shaped opening 170 or notch at the top of the aiming portion between orifices 182, 184. For example, the U-shaped opening 170 is centered between orifices 182, 184 and centered vertically with orifices 182, 184.

Figure 19:
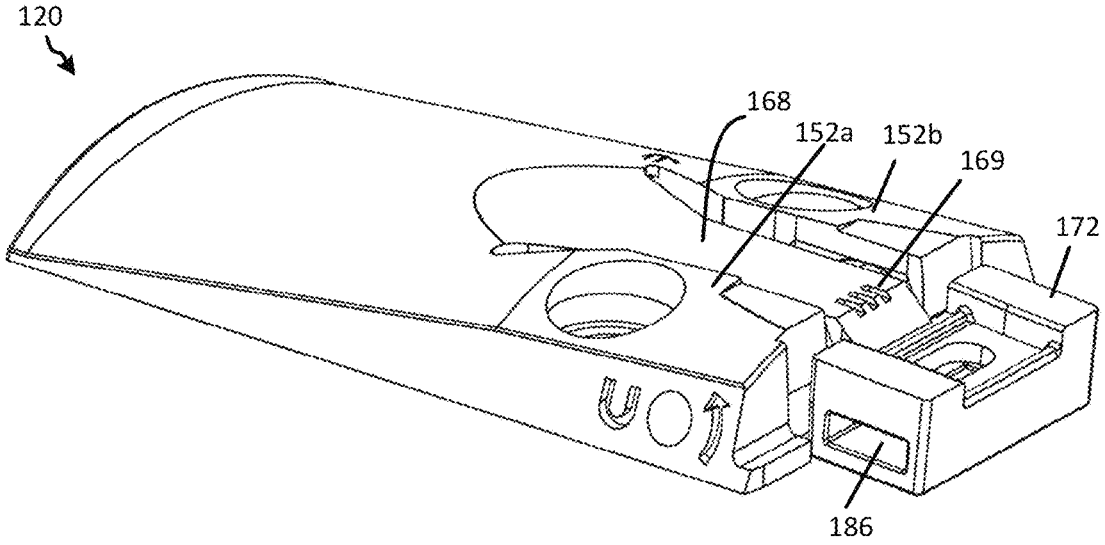
FIG. 19 shows a perspective view of portions of a rear sight according to an embodiment of this disclosure.

FIG. 19 shows a rear perspective view of rear sight 120 without aiming portions 173, 174. In FIG. 19, the elevation arm 168 is in a lowered or as-formed position, where the top surface of elevation arm 168 is below that of the lateral portions 152*a*, 152*b*. The sight portion 172 can be raised or lowered to a desired position, based at least in part on the movement of elevation arm 168. As noted above, the sight portion 172 is part of elevation arm 168 and moves based on the movement of elevation arm 168. In some embodiments, the sight portion 172 defines the aiming portion, such as having a U-shaped profile with an opening for alignment with a front sight. Alignment markings or indicia 169 are shown on the top of the elevation arm 168. In embodiments where sight portion 172 is configured for attached aiming portions 173, 174, sight portion 172 can define a cavity 186 sized to house a nut 223 that can be engaged by fastener 157, as discussed above.

Figure 20:
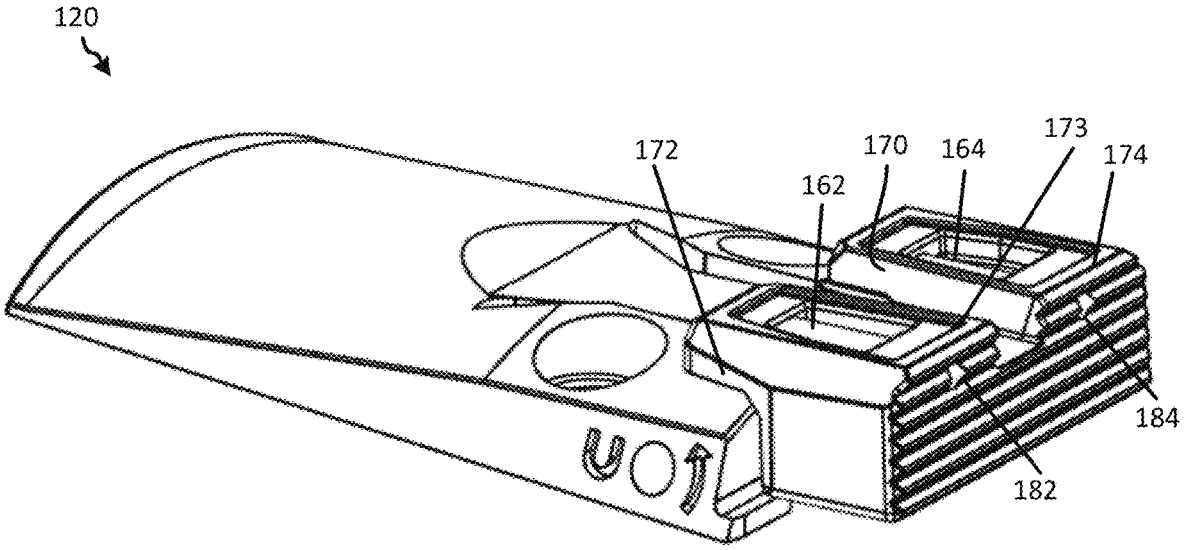
FIG. 20 shows a perspective view of a rear sight with sight portion mounted to the elevation arm according to an embodiment of this disclosure.

FIG. 20 shows a rear perspective view of rear sight 120 with aiming portions 173, 174 mounted on sight portion 172 of the elevation arm 168. The aiming portions 173 and 174 are positioned so that an operator can aim the weapon and define orifices 182 and 184, respectively. The aiming portions 173 and 174 may be attached to single sight body or sight portion 172. The orifices 182, 184 can expose an end portion of sight elements 162, 164. As also shown, opening 170 is between aiming portions 173, 174 for alignment with a front sight.

Figure 21:
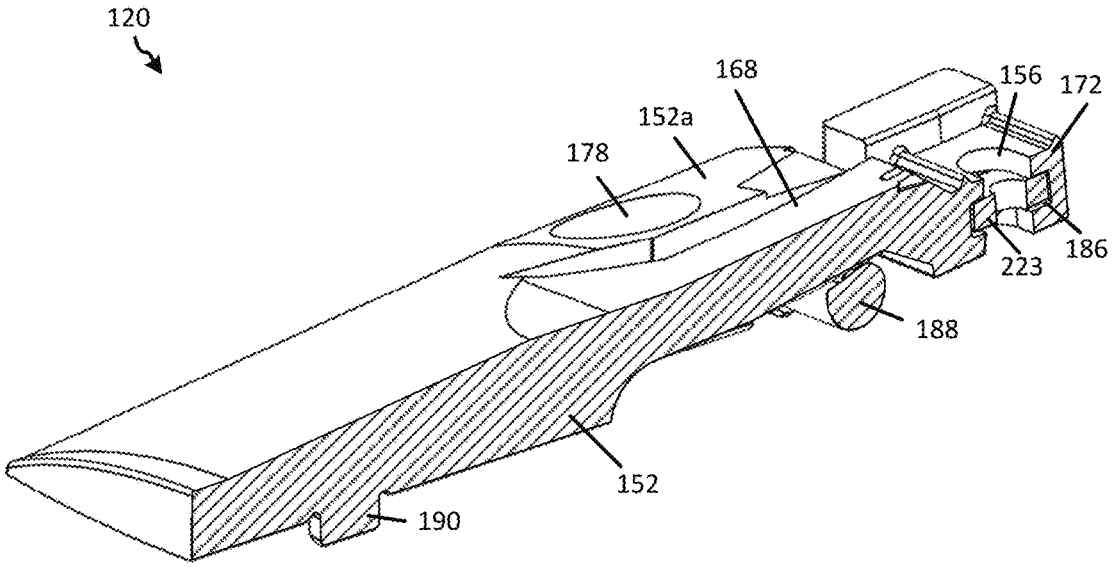
FIG. 21 shows a front perspective and sectional view of a rear sight according to an embodiment of this disclosure.

FIG. 21 shows a perspective sectional view of rear sight 120 without aiming portions 173, 174, such as shown in FIG. 19. A living hinge includes body 152 and elevation arm 168 with sight portion 172. Elevation adjustor, or cam 188, is positioned beneath the elevation arm 168 and can be used to adjust the position of the sight portion 172 up or down when rotated. The cam 188 is disposed below the elevation arm 168 and has a cam surface in contact with a bottom surface of the elevation arm 168. The cam 188 is rotatable to change a vertical position of the sight portion 172 with respect to the lateral portions 152*a*, 152*b* of the sight body 152. Protrusion 190 extends down from a bottom surface of the body 152. As noted above, the cam 188 can be accessed through an opening (e.g., opening 158 shown in FIG. 20). Fastener orifice 178 and fastener opening 156 are also shown. A nut 223 is positioned in cavity 186 of sight portion 172 to engage fastener 179 (shown in FIG. 15). Alternatively, the fastener opening 156 may be threaded in some embodiments.

The monolithic sight body 152, which includes elevation arm 168 and sight portion 172, utilizes the characteristics of flexible and resilient polymer to function as a living hinge. The elevation arm 168 can be deflected by the use of a cam 188, optionally having flats around its circumference. Flats on the cam 188 can interface with surfaces of the body 152 and/or the slide 128 to maintain the position of the cam 188 and provide tactile feedback to the user. In its deflected state, the resiliency of the material results in the elevation arm 168 exerting a downward force on the cam 188, causing the flats 191 to press against the body 152 and/or slide 128, for example.

Figure 22:
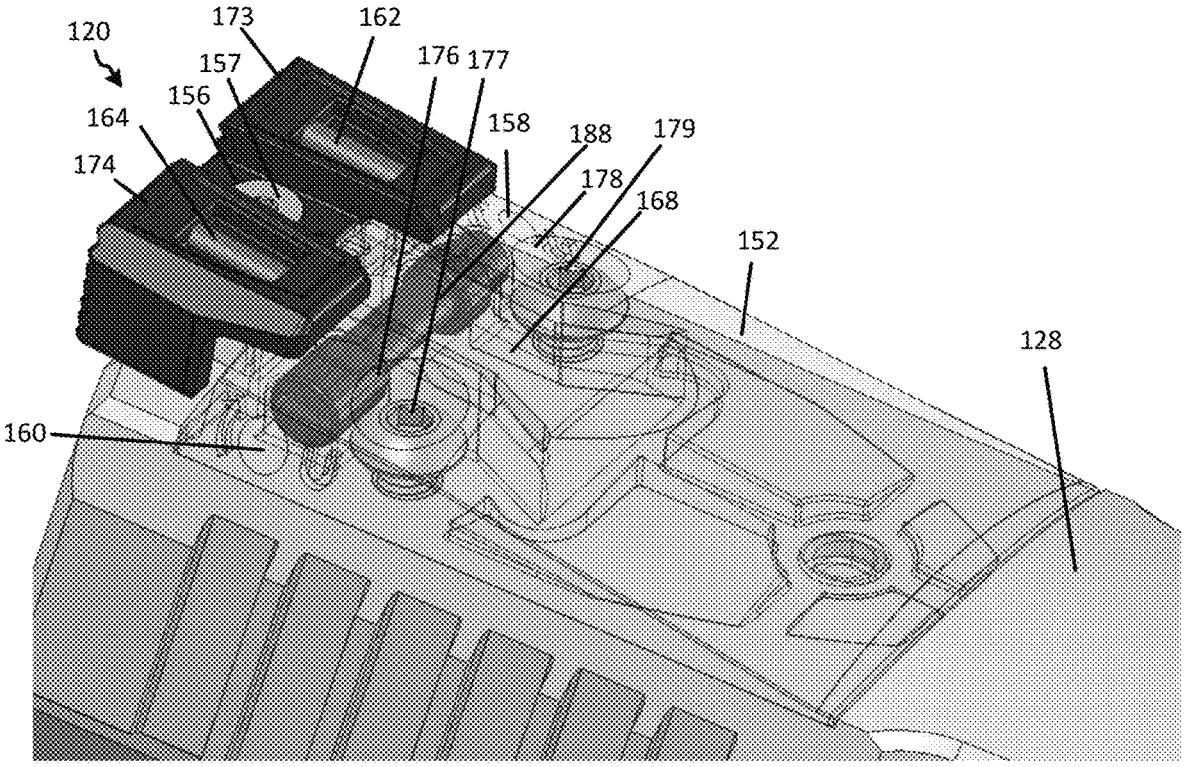
FIG. 22 shows a top perspective view of a rear sight with the sight body shown as transparent, according to an embodiment of this disclosure.

FIG. 22 shows a top perspective view of a rear sight 120 mounted on top of a handgun slide 128, where the sight body 152 is shown as transparent to better show the cam 188, which is configured generally as a cylinder or pin in this example. Cam 188 is below the elevation arm 168 and has a cam surface in contact with a bottom surface of the elevation arm 168, where the cam 188 is rotatable to change a vertical position of the aiming portions 173, 174 with respect to the body 152. Ends of the cam 188 are retained in recesses in the body 152 so that the cam 188 is below the elevation arm 168. End(s) of the cam 188 are accessible via opening 158 and/or opening 160 in the sides of the body 152. Fastener openings 176, 178 and associated fasteners 177, 179, respectively, are shown, as well as aiming portions 173, 174, sight elements 162, 164, and fastener opening 156 with fastener 157.

Figure 23:
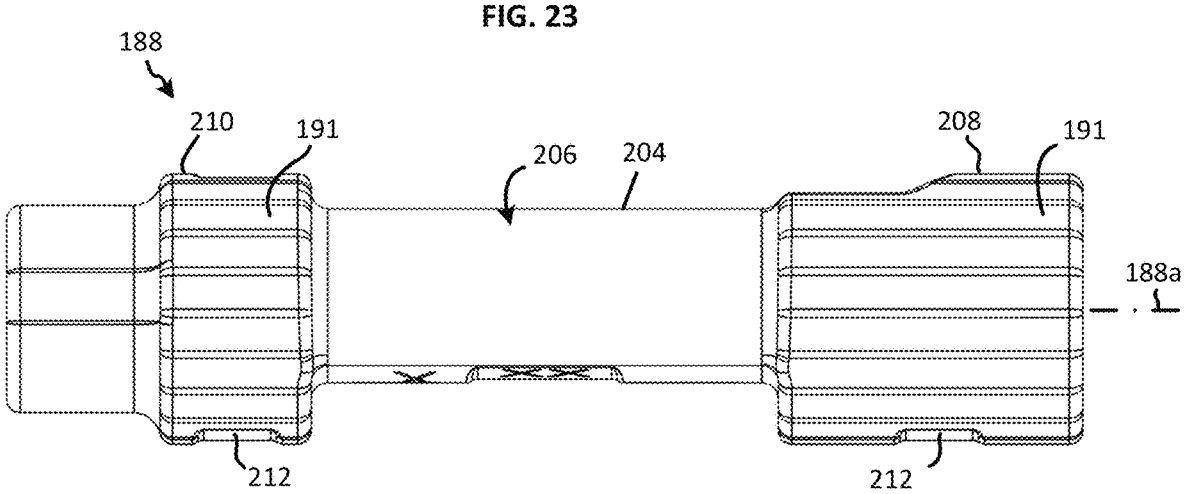
FIG. 23 shows a front view of a cam.

FIG. 23 shows a front view of a cam 188 configured as a pin, in accordance with an embodiment of the present disclosure. The cam 188 includes a cam body 204 with a cam surface 206 that is eccentric about the axis of rotation 188*a*, where the cam surface 206 is between end portions 208, 210. In some embodiments, the cam 188 is generally cylindrical with flats 191 around the outside surface of each end portion 208, 210, such as shown in FIG. 23. In use, flats 191 may contact the body 152 and/or the top of the slide 128 to provide tactile feedback (e.g., "clicks") to the user about the amount of adjustment. Any suitable number of flats 191 may be used around the outer diameter of the cam 188. In one example, each flat 191 corresponds to a rotation from 5-20°, such as about 15° of rotation. In one example, the overall length of the cam 188 is approximately 20-30 mm (0.8-1.2 inch) and the outer diameter of the enlarged end portions 208, 210, is approximately about 5-6 mm. In one embodiment, the cam body 204 provides a range of elevation change for the sight portion 172 of up to 5 mm, including up to 4 mm, up to 3 mm, a range of 1-5 mm, a range of 2-4 mm, a range of 3-5 mm, and a range of 0-3 mm, for example. Optionally, each end portion 208, 210 defines a circumferential groove 212 around all or part of the circumference. The circumferential groove(s) 212 can guide rotation of the cam 188 and may define stops and the ends of the groove(s) 212 corresponding to minimum and maximum limits of rotation. In one such embodiment, the cam 188 has a range of rotation from 180-345°, including 200-300°, 240-300°, and 260-280°. Other ranges and subranges within these ranges can be used. In other embodiments, the cam 188 can be rotated in either direction repeatedly without stops.

Figure 24:
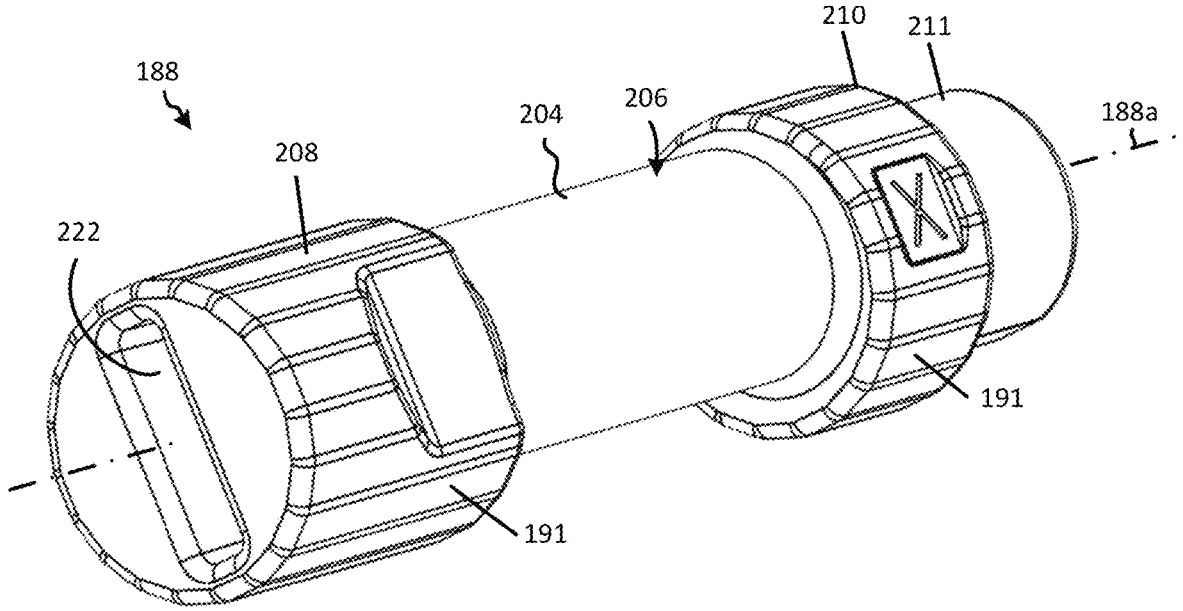
FIG. 24 shows a perspective view of a cam.

FIG. 24 shows a perspective view of cam 188, in accordance with an embodiment of the present disclosure. The cam 188 has cam body 204 with eccentric cam surface 206 as described in relation to FIG. 23. Each end portion 208, 210 defines a flat 214, 216, respectively. Flats 214, 216 provide additional tactile feedback to the user to indicate a position of minimum height for the sight portion 172. One or both end portions 208, 210 can be configured to be received in a corresponding recess in the sight body 152. In the example shown, end portion 210 includes a region of reduced diameter 211 that is received in a socket or recess in the sight body such that the cam 188 rotates about the region of reduced diameter 211. In one such embodiment, the faceted end portions 208, 210 are captured and rotate between the sight body 152 and the slide 128. Optionally, one or both ends 208*a*, 210*a* can define a tool recess 222, such as a slot, a star, a hexagon, a square, a plus, or some other shape suitable for engagement by a tool of corresponding shape. For example, a screwdriver, hex key, a star-bit or square-bit driver, or some other suitable tool can be used to rotate cam 188 using tool recess 222. The tool recess 222 in the end(s) of the cam 188, can be accessed through opening 158 or opening 160 in the side of the body 152, as discussed above.

Figure 25:
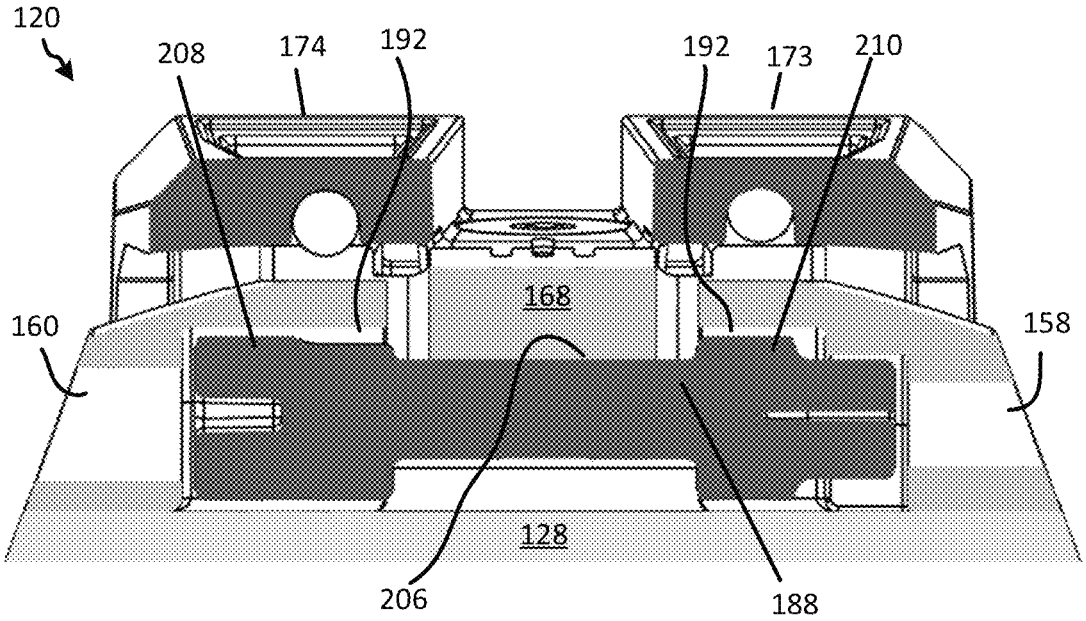
FIG. 25 shows a cross-sectional view of a rear sight assembly through the cam.

FIG. 25 shows a cross-sectional view of an embodiment of a rear sight 120 mounted on a slide 128, where the section is taken through the cam 188. Enlarged end portions 208, 210 are received in recesses 192 defined in the body 152. The cam surface 206 contacts the bottom of the elevation arm 168. Note in this example that opening 158 is of greater diameter than opening 160. In such embodiments, openings 158, 160 can be of different size and corresponding ends 208*a*, 210*a* can include different features for engagement with different tools, for example. Accordingly, one end of cam 188 may be better suited for coarse adjustment (e.g., with a screwdriver) and the opposite end of cam 188 may be better suited for fine adjustment (e.g., with a hex key). As noted above, rotation of cam 188 is useful to change the amount of deflection of the elevation arm 168, and therefore the vertical position of aiming portions 173, 174. In some embodiments, the elevation arm 168 must be deflected at least some amount from its resting state when the cam 188 is installed. As a result, the living hinge is flexed and the elevation arm 168 exerts a downward force on the cam 188.

Figure 26:
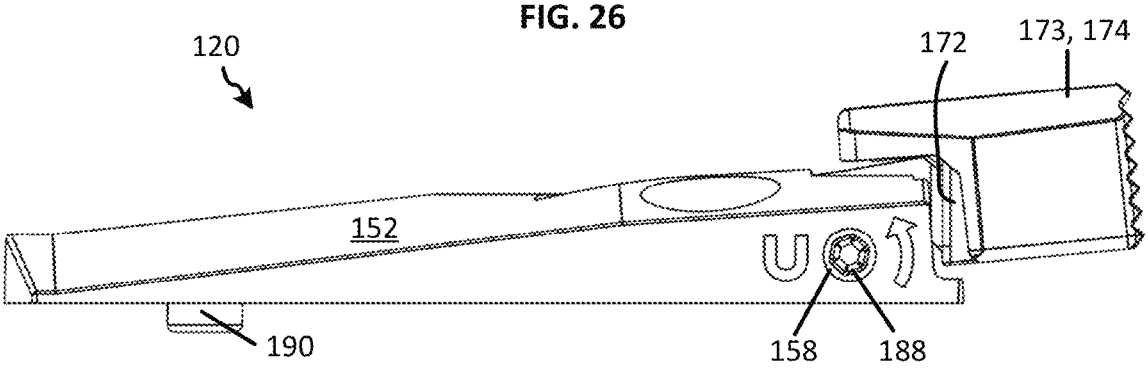
FIG. 26 shows a left-side view of a rear sight with the elevation arm in a lifted position according to an embodiment of this disclosure.

FIG. 26 shows a left-side view of the rear sight 120 with the sight portion 172 and aiming portions 173, 174 in an elevated position. An end of the cam 188 can be seen through the opening 158 on the left side of the sight body 152. Protrusion 190 extends from the bottom surface of the body 152 and can be used to align the rear sight 120 with the slide (not shown) when installed.

Figure 27:
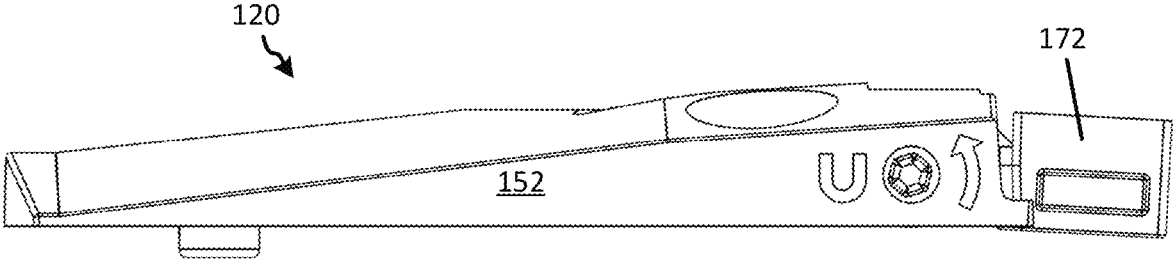
FIG. 27 shows a side view of a rear sight with the elevation arm in an as-formed or resting position according to an embodiment of this disclosure.

FIG. 27 shows a left-side view of rear sight 120 with the elevation arm 168 (not visible) in a lowered position. Aiming portions 173, 174 are omitted to more clearly show the sight portion 172.

Figure 28:
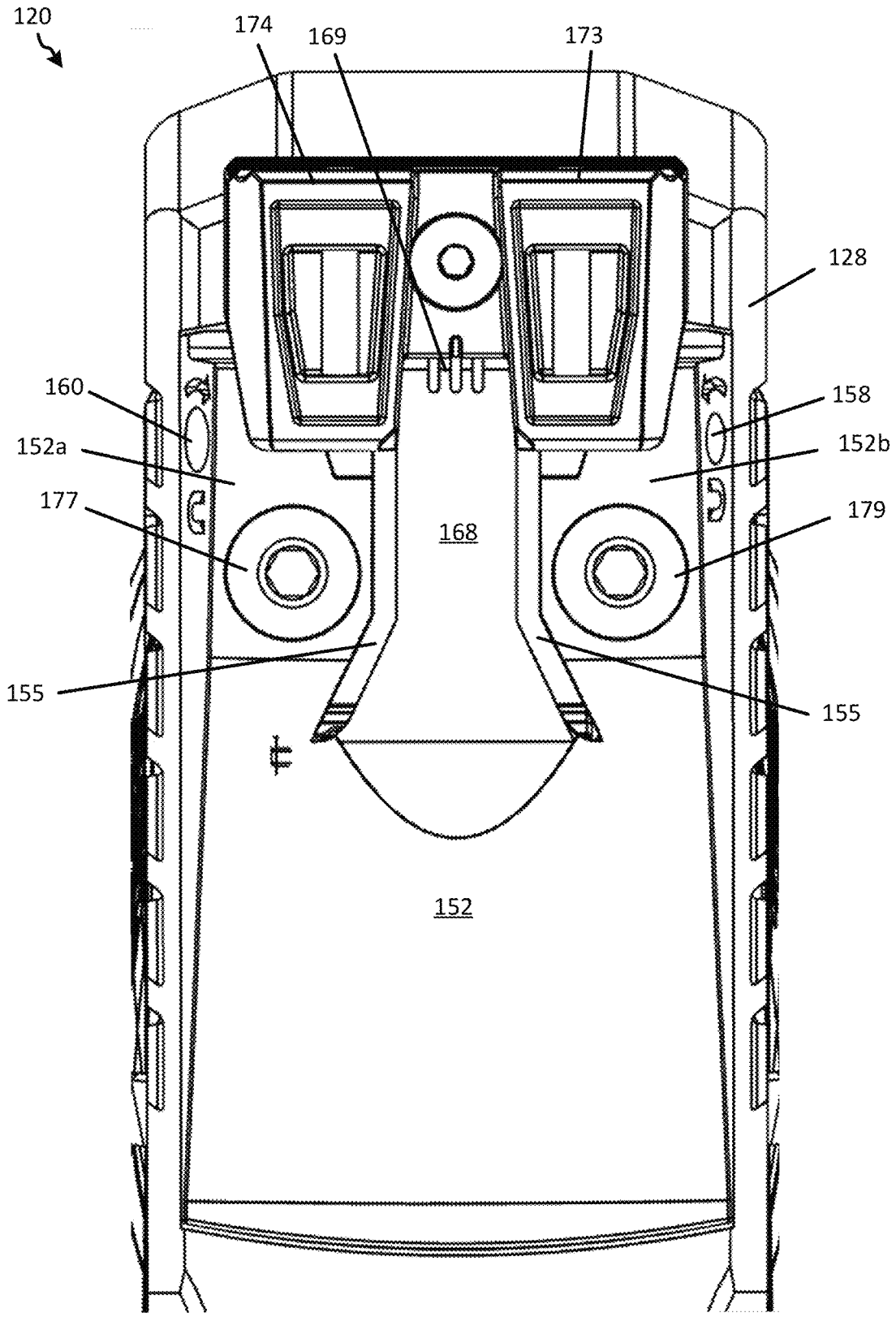
FIG. 28 shows a top plan view of a rear sight according to an embodiment of this disclosure.

FIG. 28 shows a top plan view of rear sight 120 mounted on top of a handgun slide 128, in accordance with an embodiment of the present disclosure. As shown in FIG. 28, the rear sight 120 is mounted to slide 128 and secured with fasteners 177 and 179. Elevation adjustment openings 158, 160 can be seen on sides of the body 152. Elevation arm 168 is separated from lateral portions 152*a*, 152*b* of body 152 by longitudinal gaps 155. Indicia 169 on the elevation arm 168 can be used to facilitate the right/left position of aiming portions 173 and 174. Fastener 157 secures the position of aiming portions 173, 174 as discussed above.

Slide Assembly

Figure 29:
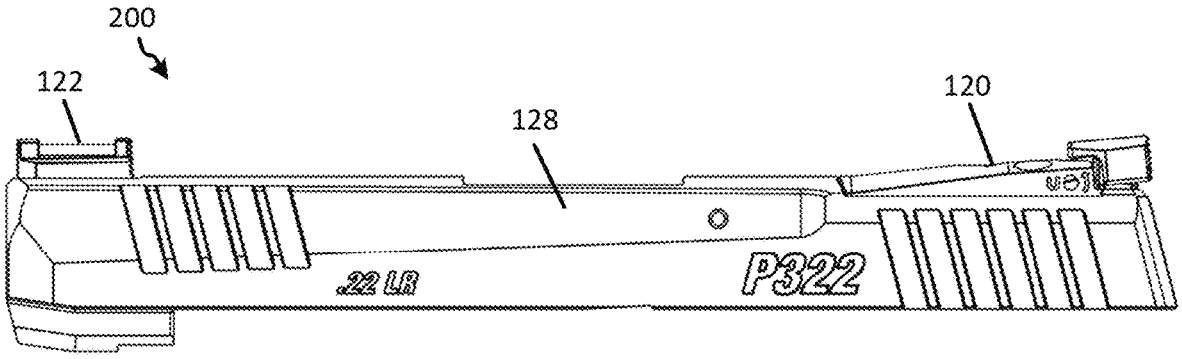
FIG. 29 shows an elevational view of the left side of a handgun slide with front and rear sight assemblies according to an embodiment of this disclosure.
Figure 30:
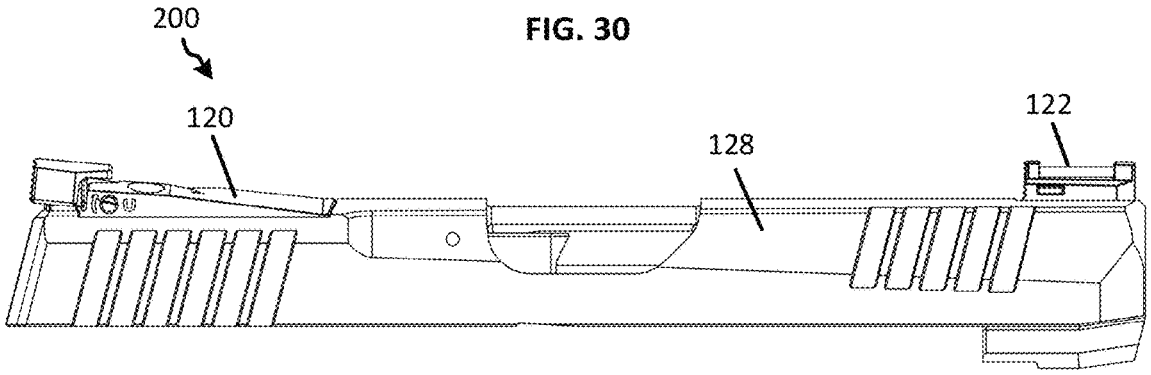
FIG. 30 shows an elevational view of the right side of a handgun slide with front and rear sight assemblies according to an embodiment of this disclosure.

FIGS. 29 and 30 show elevational views of the left side and right side, respectively, of a slide assembly 200 that includes a handgun slide 128 with a front sight 122 and rear sight 120. The slide 128 has a front sight 122, as variously disclosed herein, mounted on the distal portion of the slide 128. A rear sight 120, as variously disclosed herein, is mounted on a proximal portion of the slide 128. The front sight 122 and rear sight 120 can be provided individually or together on slide 128. Other sight combinations can be used. Numerous variations and embodiments will be apparent in light of the present disclosure.

FURTHER EXAMPLE EMBODIMENTS

The following examples pertain to further embodiments, from which numerous permutations and configurations will be apparent.

Example 1 is a sight assembly comprising a sight body with a proximal portion and a distal portion extending up from a base portion. The sight body defines a longitudinal bore therethrough along a central axis, where a majority portion of the longitudinal bore has a first diameter and a proximal end portion of the longitudinal bore has a second diameter of reduced size compared to the first diameter. The distal portion of the sight body defines a retention bore extending transversely to and intersecting a distal portion of the longitudinal bore.

Example 2 includes the subject matter of Example 1 and further comprises a longitudinal sight element sized and configured to be received in the longitudinal bore, where a cross-sectional size of the longitudinal sight element is greater than the second diameter.

Example 3 includes the subject matter of Example 2, where the sight element is selected from an optical fiber or a self-luminous tube.

Example 4 includes the subject matter of any of Examples 2 or 3, where the sight element comprises a tritium vial.

Example 5 includes the subject matter of any of Examples 1-4, where a portion of the longitudinal bore between the proximal portion and the distal portion is open to ambient light.

Example 6 includes the subject matter of any of Examples 1-5 and further comprises a retention pin configured to be disposed in the retention bore when the sight assembly is mounted to a firearm, where the retention pin is sized to occupy the distal portion of the longitudinal bore when installed in the pin opening.

Example 7 includes the subject matter of Example 6, where the retention pin is selected from an optical fiber, a fastener, a roll pin, or a dowel pin.

Example 8 includes the subject matter of any of Examples 1-7, where the sight body defines a threaded bore into a bottom of the sight body and the sight apparatus further comprises a threaded fastener configured for installation into the threaded bore.

Example 9 includes the subject matter of Example 8 and further comprises a handgun slide, where the sight body is secured to the handgun slide with the threaded fastener extending through the slide and into the threaded bore.

Example 10 is a sight assembly for a firearm. The sight assembly comprises a sight body with a proximal portion and a distal portion extending up from a base portion, the sight body defining a longitudinal bore therethrough along a central axis. A majority portion of the longitudinal bore has a first diameter and a proximal end portion of the longitudinal bore has a second diameter of reduced size compared to the first diameter. The distal portion of the sight body defines a retention bore extending transversely to and intersecting a distal portion of the longitudinal bore. A longitudinal sight element is sized and configured to be received, or is received, in the longitudinal bore, where a cross-sectional size of the longitudinal sight element is greater than the second diameter. A retention pin configured to be disposed in, or is disposed in, the retention bore, where the retention pin is sized to occupy the distal portion of the longitudinal bore when installed in the pin opening.

Example 11 includes the subject matter of Example 10, where the sight element is selected from an optical fiber or a self-luminous tube.

Example 12 includes the subject matter of any of Examples 10 or 11, where the sight element comprises a tritium vial.

Example 13 includes the subject matter of any of Examples 10-12, where the retention pin is selected from an optical fiber, a fastener, a roll pin, and a dowel pin.

Example 14 includes the subject matter of any of Examples 10-14, where the sight body defines a threaded bore into a bottom of the sight body and the sight assembly further comprises a threaded fastener configured for installation into the threaded bore.

Example 15 includes the subject matter of Example 14 and further comprises a handgun slide, where the sight body is secured to the handgun slide with the threaded fastener extending through the slide and into the threaded bore.

Example 16 is an adjustable sight for a firearm, the sight comprising a body made of a flexible and resilient polymeric material, the body including an elevation arm connected at its distal end to the body and extending proximally therefrom to a sight portion, where the elevation arm and the body comprise a monolithic structure. A cam body is below the elevation arm and has a cam surface in contact with a bottom surface of the elevation arm, where the cam body is rotatable to change a vertical position of the sight portion.

Example 17 includes the subject matter of Example 16, where the sight portion defines a slot extending axially through a top surface of the sight portion.

Example 18 includes the subject matter of Example 17, where the slot has a U-shape as viewed by a user looking at a proximal end.

Example 19 includes the subject matter of Example 16 and further comprises an aiming portion configured for removable attachment or attached to the sight portion, the aiming portion including a left aiming indicator and a right indicator.

Example 20 includes the subject matter of Example 19, where the aiming portion defines a channel extending axially through a top of the aiming portion and positioned between the left aiming indicator and the right aiming indicator.

Example 21 includes the subject matter of any of Examples 16-20, where the cam body has a generally cylindrical geometry.

Example 22 includes the subject matter of Example 21, where cam body extends crosswise to the elevation arm.

Example 23 includes the subject matter of Example 22, where at least one end portion of the cam body is received in a recess defined in the sight body.

Example 24 includes the subject matter of any of Examples 16-23, where the cam body includes one or more flats on an outer surface, each of the flats corresponding to rotation of the cam in an amount from 5 to 30 degrees.

Example 25 includes the subject matter of Example 24, where each of the flats corresponds to rotation of approximately 10-20 degrees.

Example 26 includes the subject matter of any of Examples 16-25, where the body defines at least one opening to an end of the cam body.

Example 27 includes the subject matter of any of Examples 16-26, where at least one end of the cam body defines a tool recess.

Example 28 includes the subject matter of Example 27, where the tool recess is selected from a slot, a plus, a hexagon, a square, a triangle, or a star.

Example 29 includes the subject matter of any of Examples 16-28, where the elevation arm and the body define a living hinge.

Example 30 includes the subject matter of any of Examples 16-29, where the elevation arm exerts a downward force on the cam body.

Example 31 is a handgun slide assembly comprising a slide for a semiautomatic handgun; the sight assembly of any one of Examples 1-14, where the sight assembly is mounted to a top and distal portion of the slide; and/or the adjustable sight of any one of Examples 16-30, where the adjustable sight mounted to a top and proximal portion of the slide.

Example 32 includes the subject matter of Example 31 and includes both the sight assembly of any of Examples 1-14 and the adjustable sight of any of Examples 16-30.

Example 33 includes the subject matter of Example 32, where the adjustable sight is mounted in a recess defined in a top surface of the slide.

Example 34 is a handgun including the handgun slide of any of Examples 31-33.

Example 35 is a long gun comprising a barrel, the sight assembly of any of Examples 1-14, where the sight assembly is mounted to a top and distal portion of the barrel; and/or the adjustable sight of any of Examples 16-30, where the adjustable sight is mounted to a top and proximal portion of the barrel.

Example 36 includes the subject matter of Example 35 and includes both the sight assembly of any one of Examples 1-14 and the adjustable sight of any one of Examples 16-30.

Example 37 includes the subject matter of any of Examples 35 or 36, where the long gun is a rifle or a shotgun.

Example 38 includes the subject matter of any of Examples 35 or 36, where the long gun is a semiautomatic rifle.

The foregoing description of example embodiments has been presented for the purposes of illustration. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A sight assembly comprising:

a sight body with a proximal end portion and a distal end portion each extending up from a base portion in a spaced relationship, the sight body defining a longitudinal bore along a central axis that extends through the proximal end portion and through the distal end portion, wherein wherein the longitudinal bore has a reduced, diameter along a proximal part of the proximal end portion and wherein the distal portion of the sight body defines a retention bore extending upward through a bottom of the base portion and intersecting the longitudinal bore in the distal end portion;

a pin sized to be received in the retention bore with part of the pin occupying the longitudinal bore in the distal end portion; and a sight element sized to be retained between the reduced diameter of proximal end portion and the pin when the pin is installed in the retention bore.

2. The sight assembly of claim 1, where the sight element is selected from an optical fiber or a self-luminous tube.

3. The sight assembly of claim 2, wherein a majority portion of the longitudinal bore between the proximal portion and the distal portion is open to ambient light.

4. The sight assembly of claim 1, wherein the retention pin is selected from an optical fiber, a fastener, a roll pin, or a dowel pin.

5. The sight assembly of claim 1, further comprising a handgun slide and a threaded fastener, wherein the sight body defines a threaded bore into a bottom of the sight body and the sight body is secured to the handgun slide with the threaded fastener extending through the slide and into the threaded bore.

6. A sight assembly for a firearm, the sight assembly comprising:

a sight body with a proximal portion and a distal portion each extending up from a base portion in a spaced relationship, the sight body defining a longitudinal bore along a central axis through the proximal portion and the distal portion, wherein the longitudinal bore has a reduced diameter along a proximal part of the proximal portion and wherein the sight body defines a retention bore extending transversely to and intersecting the longitudinal bore in the distal portion;

a pin in the retention bore, wherein the part of the pin occupies the longitudinal bore in the distal portion; and a sight element retained in the longitudinal bore between the reduced diameter and the transverse bore.

7. The sight assembly of claim 6, wherein the sight element is selected from an optical fiber or a self-luminous tube.

8. The sight assembly of claim 6, wherein the retention pin is selected from an optical fiber, a fastener, a roll pin, and a dowel pin.

* * * * *